US009448520B2

(12) United States Patent
Aoki

(10) Patent No.: US 9,448,520 B2
(45) Date of Patent: Sep. 20, 2016

(54) APPARATUS AND MEASUREMENT METHOD BASED ON INCIDENT POSITIONS OF EMITTED LIGHT

(71) Applicant: CANON KABUSHIKI KAISHA, Tokyo (JP)

(72) Inventor: Kunitoshi Aoki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/679,434

(22) Filed: Apr. 6, 2015

(65) Prior Publication Data

US 2015/0293489 A1 Oct. 15, 2015

(30) Foreign Application Priority Data

Apr. 11, 2014 (JP) ..... 2014-082311

(51) Int. Cl.
*G03G 15/00* (2006.01)

(52) U.S. Cl.
CPC ..... *G03G 15/556* (2013.01); *G03G 15/5041* (2013.01)

(58) Field of Classification Search
CPC ..... G03G 15/556; G03G 15/5041
See application file for complete search history.

(56) References Cited

U.S. PATENT DOCUMENTS 5,778,280 A * 7/1998 Komiya ..... G03G 15/0194 347/116
7,133,056 B2 * 11/2006 Tanaka ..... G03G 15/0131 347/116
7,796,902 B2 * 9/2010 Watanabe ..... G03G 15/5037 399/46
8,532,509 B2 * 9/2013 Yashima ..... G03G 15/161 399/301
2004/0141765 A1 * 7/2004 Shimura ..... G03G 15/0855 399/49
2004/0253014 A1 * 12/2004 Bares ..... G03G 15/5058 399/49
2007/0172246 A1 * 7/2007 Murayama ..... G03G 15/5058 399/49
2009/0010664 A1 * 1/2009 Nukada ..... G03G 5/10 399/49
2009/0041493 A1 * 2/2009 Kakutani ..... G03G 15/0131 399/58
2009/0238590 A1 * 9/2009 Masuda ..... G03G 15/0178 399/49
2010/0021196 A1 * 1/2010 Atsumi ..... G03G 15/5041 399/74
2010/0166443 A1 * 7/2010 Muto ..... G03G 15/5058 399/49
2010/0166445 A1 * 7/2010 Aoki ..... G03G 15/5058 399/53
2010/0322648 A1 * 12/2010 Kojima ..... G03G 15/5041 399/49
2011/0052230 A1 * 3/2011 Isoda ..... G03G 15/0194 399/49
2011/0188056 A1 * 8/2011 Muto ..... G01B 11/28 356/630
2012/0243891 A1 * 9/2012 Watanabe ..... G03G 15/5058 399/49

FOREIGN PATENT DOCUMENTS

JP H08327331 A 12/1996

* cited by examiner

*Primary Examiner* — David Bolduc
(74) *Attorney, Agent, or Firm* — Carter, DeLuca, Farrell & Schmidt, LLP

(57) ABSTRACT

There is provided with an apparatus. A measurement unit emits light to an image carrier conveying a toner image and measures an incident position of the light in a direction perpendicular to a surface of the image carrier by observing the emitted light. The measurement unit has an irradiation unit configured to emit the first light and the second light and an observation unit configured to observe the first light and the second light. The irradiation unit emits the first light and the second light at positions separate from each other in a direction perpendicular to a conveyance direction of the toner image, with irradiation directions of the first light and the second light being substantially orthogonal to the direction perpendicular to the conveyance direction of the toner image.

15 Claims, 21 Drawing Sheets

APPARATUS AND MEASUREMENT METHOD BASED ON INCIDENT POSITIONS OF EMITTED LIGHT

BACKGROUND OF THE INVENTION

1. Field of the Invention

The present invention relates to an apparatus and a measurement method.

2. Description of the Related Art

The color of an image formed by an image forming apparatus using an electrophotographic method, electrostatic recording method, or the like, such as a copying machine, laser printer, or facsimile apparatus, varies with changes in various physical parameters. For example, since the latent image potential, toner replenishment amount, transfer efficiency, and the like change with variations in temperature, humidity, and the like, the amount of toner adhering to the photosensitive drum and the transfer belt is not constant.

Japanese Patent Laid-Open No. 8-327331 discloses a method of measuring the thickness (layer thickness) of a toner patch by using a laser displacement gauge. More specifically, a spot light beam irradiates an image carrier which carries the toner patch. The reflected light is then formed into an image at a position corresponding to the thickness of the toner patch on the image carrier. A PSD (Position Sensing Device) or the like detects a change in the image formation position of light when the toner patch passes through the irradiation position of the spot light beam, thereby measuring the thickness of the toner patch. Feedback control is performed for an image formation process based on the thickness of this toner patch.

SUMMARY OF THE INVENTION

According to an embodiment of the present invention, an apparatus comprises: a measurement unit configured to emit light to an image carrier conveying a toner image and to measure an incident position of the light in a direction perpendicular to a surface of the image carrier by observing the emitted light; and a calculation unit configured to calculate a thickness of the toner image based on an incident position of first light measured by observing the first light entering a surface of the toner image and an incident position of second light measured by observing the second light entering a surface of the image carrier, wherein the first light entering the surface of the toner image and the second light entering the surface of the image carrier are simultaneously observed, wherein the measurement unit comprises an irradiation unit configured to emit the first light and the second light and an observation unit configured to observe the first light and the second light, and the irradiation unit is further configured to emit the first light and the second light at positions separate from each other in a direction perpendicular to a conveyance direction of the toner image, with irradiation directions of the first light and the second light being substantially orthogonal to the direction perpendicular to the conveyance direction of the toner image.

According to another embodiment of the present invention, a measurement method comprises: emitting first light and second light to an image carrier conveying a toner image, wherein the first light and the second light are emitted to positions separate from each other in a direction perpendicular to a conveyance direction of the toner image, and wherein irradiation directions of the first light and the second light are substantially orthogonal to the direction perpendicular to the conveyance direction of the toner image; measuring an incident position of the first light and the second light in a direction perpendicular to a surface of the image carrier through observing the emitted first light and second light; and calculating a thickness of the toner image based on an incident position of the first light measured by observing the first light entering a surface of the toner image and an incident position of second light measured by observing the second light entering a surface of the image carrier, wherein the first light entering the surface of the toner image and the second light entering the surface of the image carrier are simultaneously observed.

According to still another embodiment of the present invention, an apparatus comprises: a forming unit configured to form a measurement toner image on an image carrier conveying a toner image, wherein the measurement toner image has different lengths in the conveyance direction for each position in a direction perpendicular to the conveyance direction of the toner image; an irradiation unit configured to emit light to the image carrier conveying the toner image; a measurement unit configured to measure a length of the measurement toner image passing through an incident position of the emitted light in the conveyance direction of the toner image by observing the emitted light; and a determination unit configured to determine an incident position of the emitted light in a direction perpendicular to the conveyance direction of the toner image in accordance with the measurement result.

According to yet another embodiment of the present invention, a measurement method comprises: forming a measurement toner image on an image carrier conveying a toner image, wherein the measurement toner image has different lengths in the conveyance direction for each position in a direction perpendicular to the conveyance direction of the toner image; measuring a length of the measurement toner image passing through an incident position of an emitted light in the conveyance direction of the toner image through observing the emitted light; and determining an incident position of the emitted light in a direction perpendicular to the conveyance direction of the toner image in accordance with the measurement result.

Further features of the present invention will become apparent from the following description of exemplary embodiments (with reference to the attached drawings).

DESCRIPTION OF THE EMBODIMENTS

The method disclosed in Japanese Patent Laid-Open No. 8-327331 suffers from a problem that errors occur in measurement values because of vibration and undulation of an image carrier. That is, the method disclosed in Japanese Patent Laid-Open No. 8-327331 detects the height of the surface of a toner patch as the distance from the reference surface of an image carrier. Therefore, when the distance between the image carrier surface and the reference surface changes, in other words, the distance between the image carrier surface and the measurement apparatus changes, because of mechanical factors such as vibration and undulation, an error occurs in a measurement value.

According to an embodiment of the present invention, it is possible to accurately detect the thickness of a toner image.

An embodiment of the present invention will be described below with reference to the accompanying drawings. Note however that the scope of the present invention is not limited to the embodiments to be described below.

First Embodiment

In the first embodiment, two spot light beams respectively irradiate an image carrier and a toner image. The obtained image is split into two images, and a toner amount (toner adhesion amount) is calculated by using the respective split images.

(Arrangement of Image Forming Apparatus)

Figure 1A:
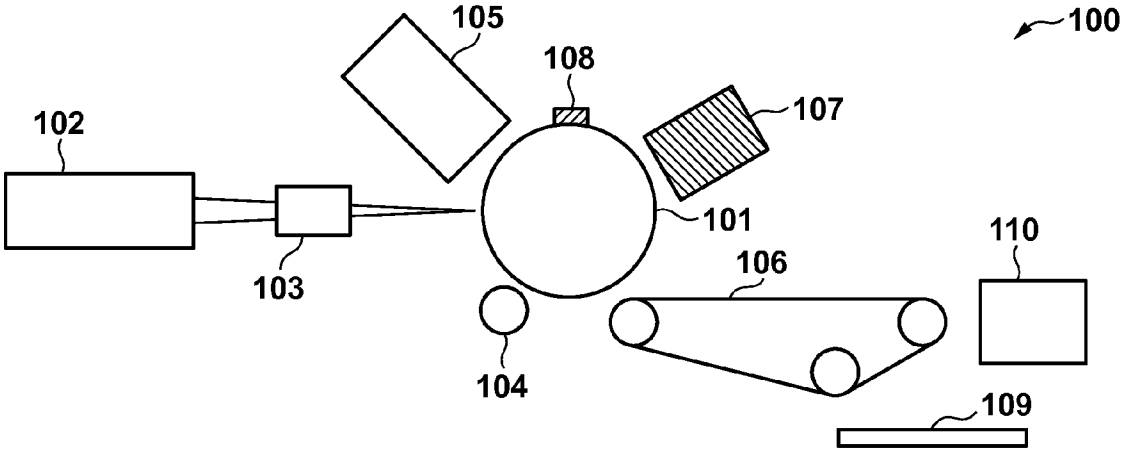
FIGS. 1A and 1B are views showing the arrangement of an image forming apparatus according to an embodiment.
Figure 1B:
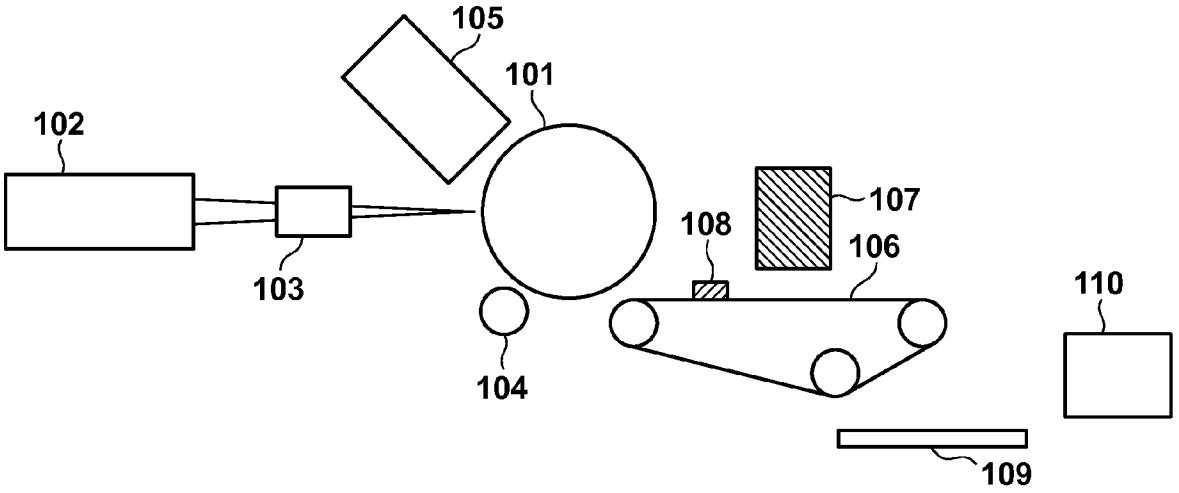

FIGS. 1A and 1B show an example of the arrangement of an image forming apparatus according to the first embodiment. Image forming apparatuses according to the second to seventh embodiments (to be described later) have the same arrangement. An image forming apparatus 100 shown in FIG. 1A includes a photosensitive drum 101 as an image carrier, an exposure laser 102, a polygon mirror 103, a charge roller 104, a developing device 105, a transfer belt 106, a measurement apparatus 107, and a fixing device 110.

The image forming apparatus 100 is an image forming apparatus using the electrophotographic method. Although the operation principle of the image forming apparatus using the electrophotographic method is known, the operation of the image forming apparatus 100 will be simply described below. First of all, the charge roller 104 charges the surface of the photosensitive drum 101. The exposure laser 102 then forms an electrostatic latent image on the surface of the photosensitive drum 101 via the polygon mirror 103. The developing device 105 forms a toner patch 108 as a toner image for thickness measurement on the photosensitive drum 101. The measurement apparatus 107 measures the toner amount of the toner patch 108 after development.

As shown in FIG. 1B, the measurement apparatus 107 may measure the toner amount of the toner patch 108 after it is transferred from the photosensitive drum 101 to the transfer belt 106. A measurement procedure for the toner amount of the toner patch 108 on the photosensitive drum 101 is the same as that for the toner patch 108 on the transfer belt 106. A case in which the toner amount of the toner patch 108 on the transfer belt 106 is measured will be described below with reference to FIG. 1B.

(Feedback Control Based on Toner Amount Measurement)

Figure 2:
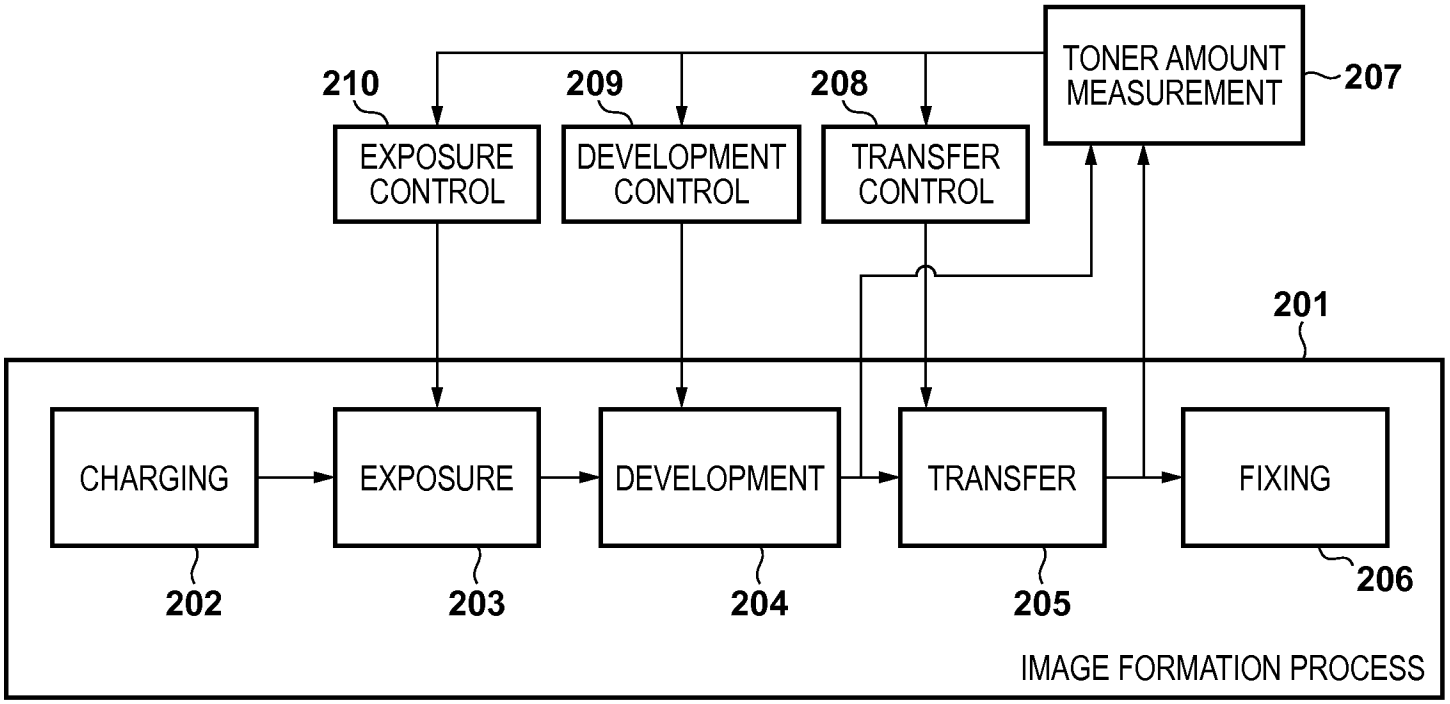
FIG. 2 is a block diagram showing an example of feedback control.

FIG. 2 is a control block diagram concerning feedback control based on toner amount measurement. As shown in FIG. 2, an image formation process 201 is controlled in accordance with the result obtained by toner amount measurement 207. That is, a formation unit for forming a toner image on an image carrier, such as the exposure laser 102 or developing device 105, is controlled based on the thickness of the toner patch measured by the measurement apparatus 107. More specifically, after a developing process 204 or a transfer process 205, the toner amount measurement 207 is performed in the above manner. Subsequently, transfer control 208, development control 209, and exposure control 210 are performed based on the measured toner amount, thereby controlling the transfer process 205, the developing process 204, and an exposure process 203. More specifically, if the toner amount is larger than a predetermined amount, each process is controlled to reduce the toner amount. With this feedback control, it is possible to suppress variations in color on an output image from the image forming apparatus 100.

In an image forming apparatus using the electrophotographic method, such a feedback control method is known, and is not specifically limited. For example, it is possible to control the thickness of a toner film when outputting an image with the maximum density, based on the thickness of a toner patch measured by the measurement apparatus 107. In addition, it is possible to convert the thickness of a toner patch into a density and control the density of an image to be output based on the obtained density. A triboelectricity quantity (a charge amount per unit weight) may be controlled by calculating a triboelectricity quantity from the thickness of a toner patch based on the charge amount of toner measured by another methods. As a concrete control example, it is possible to change an image density by adjusting a density output level ($\gamma$ characteristic) by changing a laser output characteristic in exposure control. Alternatively, it is possible to change the thickness of a toner film or triboelectricity quantity at the time of maximum density output by adjusting a developing bias voltage or toner replenishment amount by development control or adjusting a transfer current in transfer control.

Such toner amount measurement and feedback control can be performed at the time of variation in printer environment, for example, after toner cartridge replacement, printing of a predetermined number of sheets, or power-on of the printer main body. When performing feedback control, toner patches having various densities are formed on the photosensitive drum 101 or the transfer belt 106. The toner amounts of the respective toner patches are then measured. Thereafter, image formation conditions are controlled based on the measurement results.

The thickness (or average thickness) of a toner patch 108 is proportional to a toner amount. It is therefore possible to calculate a toner amount from the thickness of the toner patch 108 calculated in this manner. The thickness of the toner patch 108 calculated in this manner may be handled as a toner amount. The thickness of the toner patch 108 will be referred to as a toner amount hereinafter.

(Arrangement of Measurement Apparatus 107)

Figure 3:
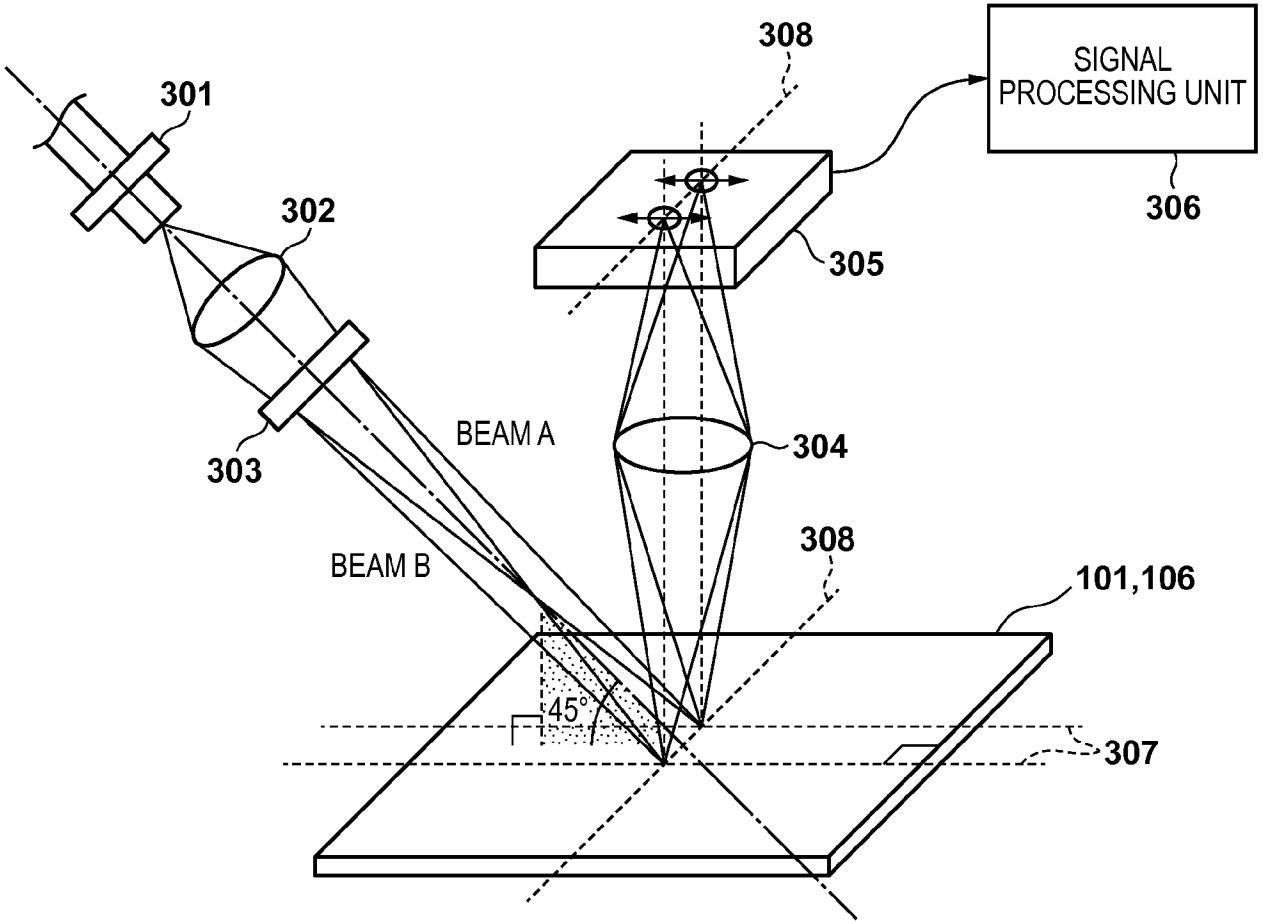
FIG. 3 is a view showing an example of the arrangement of a measurement apparatus according to the first embodiment.

The measurement apparatus 107 according to this embodiment includes an irradiation unit which irradiates an image carrier, which carries a toner image, with light and an observation unit which observes irradiated light, and measures the incident position of light in a direction perpendicular to the surface of the image carrier. FIG. 3 shows an example of the arrangement of the measurement apparatus 107. The measurement apparatus 107 includes a laser light source 301, a condenser lens 302, a diffraction grating 303, a receiver lens 304, an area sensor 305, and a signal processing unit 306. The laser light source 301, the condenser lens 302, and the diffraction grating 303 constitute an irradiation unit. The receiver lens 304 and the area sensor 305 constitute an observation unit.

The laser light source 301 is, for example, a laser diode, and irradiates the photosensitive drum 101 or transfer belt 106 (to be referred to as an image carrier hereinafter) with light. The condenser lens 302 condenses laser light from the laser light source 301 into a small spot. In this embodiment, the optical axis of laser light from the laser light source 301 and the condenser lens 302 is set to form an angle of about 90° with a main-scanning axis 308 and have an elevation angle of about 45° from the image carrier surface. In this case, a sub-scanning axis 307 represents an axis parallel to the sub-scanning direction of the image carrier (the direction in which the image carrier moves, that is, the direction in which a toner image is conveyed).

The diffraction grating 303 splits a spot light beam from the laser light source 301 and the condenser lens 302 into two light beams. In this embodiment, the spot light beam is split into two spot light beams juxtaposed along the main-scanning axis 308. In this case, the main-scanning axis 308 represents an axis parallel to the main-scanning direction of the image carrier (the scanning direction of laser light from the exposure laser 102, which is normally perpendicular to the moving direction of the image carrier and parallel to the image carrier surface). There is no need to use the diffraction grating 303 to split light. For example, it is possible to use a beam splitter or half mirror.

The two split spot light beams enter the image carrier and are reflected by the toner patch 108 as a measurement target or the image carrier. The reflected light beams are formed into images on the area sensor 305 through the receiver lens 304. In this embodiment, the area sensor 305 is an area type image sensor, that is, an image sensor having a two-dimensional array of pixels, which captures images of emitted spot light beams. In this manner, different images (reflection images) are obtained in accordance with the difference in thickness between toner films adhering on the image carrier.

In this embodiment, the area sensor 305 captures images of two spot light beams which irradiate the surface of the toner patch 108 or the surface of the image carrier. It is possible to use, instead of the area sensor 305, another sensor which can simultaneously detect the incident positions of two spot light beams on the sensor in a one-dimensional direction. For example, it is possible to use two line sensors which detect the positions of spot light beams in a direction parallel to the sub-scanning axis 307 and to synchronously drive the line sensors.

In this embodiment, a spot light beam enters from a direction tilted with respect to the surface of the image carrier, that is, a direction which is not perpendicular to the surface of the image carrier. For this reason, the incident position of the spot light beam on the toner patch 108 changes in a direction parallel to the sub-scanning axis 307 in accordance with the height of the toner patch 108. In this manner, the position of diffuse-reflected light on the area sensor 305 changes in a direction parallel to the sub-scanning axis 307 in accordance with a change in the height of a measurement target. The embodiment is configured to continuously perform observation of the incident position of the spot light beam on the surface of the image carrier or toner patch 108 by using the area sensor 305. This will detect a temporal change in the incident position of the spot light beam on the surface of the image carrier or toner patch 108.

This embodiment is configured to detect changes in the positions of two spot light beams, located at positions separate from each other in a direction along the main-scanning axis 308, in a direction along the sub-scanning axis 307. In the embodiment, as the area sensor 305, an area type image sensor which detects a two-dimensional light distribution is used. The signal processing unit 306 stores the reflection images captured by the area sensor 305. These images are used for the calculation of a toner amount afterward. The measurement apparatus 107 described above can simultaneously measure the reflection positions of light beams at a plurality of positions separate from each other.

In this embodiment, as will be described later, the irradiation unit irradiates the surface of the toner patch 108 with one spot light beam (beam A). The irradiation unit also irradiates the surface of the image carrier with one spot light beam (beam B). More specifically, when the toner patch 108 is conveyed to the irradiation positions of beams A and B by the image carrier, beam A irradiates the surface of the toner patch 108. On the other hand, while beam A irradiates the surface of the toner patch 108, beam B always irradiates the surface of the image carrier. The observation unit then simultaneously observes beams A and B which irradiate the surface of the toner patch 108 or the surface of the image carrier by the irradiation unit. Difference measurement is performed based on the two observation results obtained in this manner.

Figure 4A:
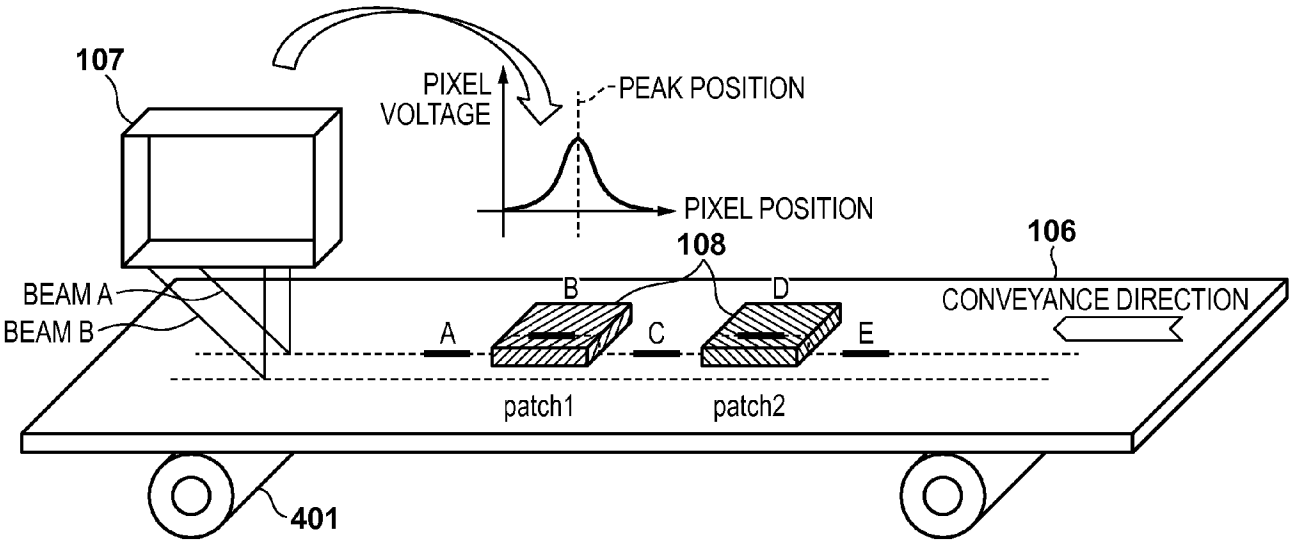
FIGS. 4A and 4B are views for explaining a method of measuring the thickness of a toner patch.

A method of measuring a toner patch shape by using the measurement apparatus 107 will be described with reference to FIG. 4A. The area sensor 305 continuously captures an image carrier image or toner patch image which reflects light. More specifically, the area sensor 305 repeats the operation of accumulating reflected light for a predetermined time based on a set sampling frequency and the operation of outputting the waveform of reflected light obtained in this period as a one-frame reflection image. The image carrier is driven by a driving roller 401 to move in the direction of the sub-scanning axis 307 at a predetermined process speed while carrying the toner patch 108. That is, the measurement apparatus 107 continuously captures and stores reflected waveforms from the image carrier or toner patch at given sampling intervals.

The measurement apparatus 107 starts emitting laser light and storing reflected waveforms before the toner patch reaches the irradiation points of laser light beams (beams A and B). Two beams A and B split by the diffraction grating 303 are reflected by the image carrier or toner patch and simultaneously enter the area sensor 305. The measurement apparatus 107 splits the reflection image captured by the area sensor 305 into a region where reflected beam A is reflected and a region where reflected B is reflected. The measurement apparatus 107 then stores an image in which beam A is reflected and an image in which beam B is reflected as independent image data.

The measurement apparatus 107 detects the reflection positions of the laser light beams (or the incident directions of the reflected laser light beams to the area sensor 305) by performing signal processing (to be described later) for the image data obtained in this manner. The measurement apparatus 107 can generate time-series data representing changes in the reflection positions of laser light beams over a given time by respectively performing signal processing for the continuously captured image data.

In this embodiment, the toner patch 108 is arranged on the image carrier such that the toner patch 108 is irradiated with beam A and is not irradiated with beam B.

(Method of Calculating Toner Amount)

A method of calculating a toner amount by using the reflection of laser light according to this embodiment will be briefly described with reference to FIGS. 13A and 13B. As described above, in this embodiment, a spot light beam enters from a direction tilted with respect to the surface of an image carrier.

Figure 13A:
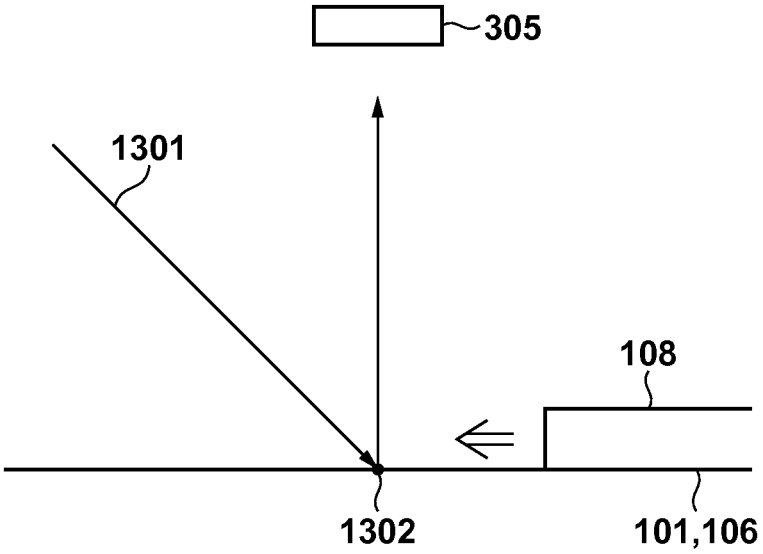
FIGS. 13A and 13B are views showing a method of measuring the thickness of a toner patch.

Referring to FIG. 13A, laser light 1301 enters a light irradiation point 1302 on the image carrier. In this case, when the area sensor 305 captures an image (reflection image) around the light irradiation point 1302, the laser light reflected on the image carrier is observed as a bright point at the light irradiation point 1302.

Figure 13B:
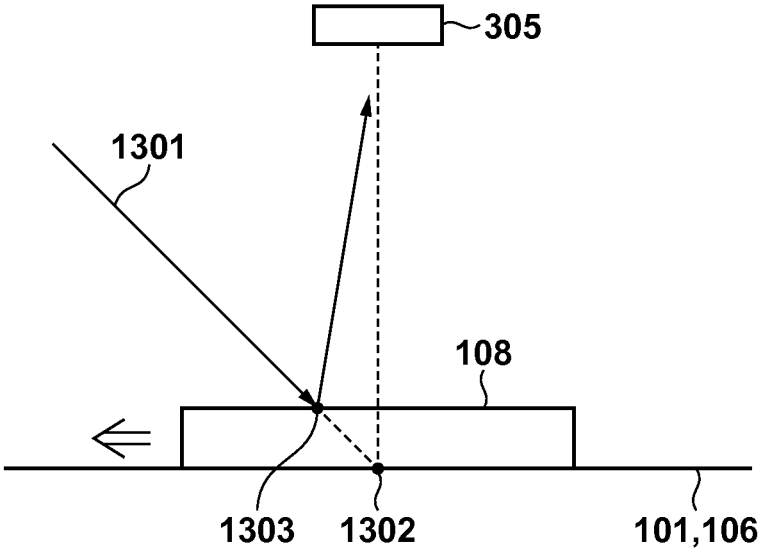

Referring to FIG. 13B, when the image carrier moves, the toner patch 108 on the image carrier moves onto the light irradiation point 1302. When the area sensor 305 captures an image (reflection image) around the light irradiation point 1302, the laser light reflected on the image carrier is observed as a bright point at an incident position 1303. Because of the thickness of the toner patch 108, the position of the light irradiation point 1302 differs from the position of the incident position 1303 in a direction along the surface of the image carrier.

More specifically, the position of the incident position 1303 in a direction along the surface of the image carrier depends on the position of the incident position 1303 in a direction perpendicular to the surface of the image carrier. In other words, the position of the incident position 1303 on a surface in a direction along the surface of the image carrier depends on the distance between a reference plane parallel to the surface of the image carrier and the position of the incident position 1303. As described above, the position of the incident position 1303 in a direction perpendicular to the surface of the image carrier can be decided by measuring the position of the incident position 1303 on the surface of the image carrier in a direction along the surface of the image carrier. In other words, the position of the incident position 1303 on the surface of the image carrier in a direction along the surface of the image carrier indicates the position of the incident position 1303 in a direction perpendicular to the surface of the image carrier.

In this manner, the difference between the position of a bright point when laser light enters the image carrier surface and the position of a bright point when laser light enters the toner patch 108 is detected in an image (reflection image) around the light irradiation point 1302 captured by using the area sensor 305. For example, assuming that there is no vibration or undulation of the image carrier and the position of the image carrier is always constant, a thickness t of the toner patch 108 is proportional to a distance d between the light irradiation point 1302 and the incident position 1303 in a direction along the surface of the image carrier. It is possible to calculate the thickness of the toner patch 108 based on the shift detected in this manner.

A method of calculating the thickness of the toner patch 108 is not specifically limited. In this embodiment, the incident position of beam A on the surface of the toner patch 108 is measured, which has been measured when the toner patch 108 has passed through the incident position of beam A. In addition, the incident position of beam A on the surface of the image carrier is measured, which has been measured before or after the toner patch 108 has passed through the incident position of beam A. The thickness of the toner patch 108 is calculated based on the difference between these incident positions. In this case, an incident position may be the incident position of beam A in a direction perpendicular to the surface of the image carrier or the incident position of beam A in a direction along the surface of the image carrier.

According to another embodiment, it is possible to calculate the thickness of the toner patch 108 from the difference between the measurement value of the incident position of beam A on the surface of the toner patch 108 and a predetermined value indicating the incident position of beam A on the surface of the image carrier. A predetermined value indicating the incident position of beam A on the surface of the image carrier may be the value predetermined at the time of the manufacture of the image forming apparatus 100 or the value measured by periodically measuring the incident position of beam A on the surface of the image carrier.

It is not essential that the irradiation unit including the laser light source 301 and the observation unit including the area sensor 305 are arranged in the positional relationship shown in FIG. 3. It is possible to measure the incident position of light in a direction perpendicular to the surface of the image carrier as long as the irradiation direction of light from the irradiation unit is tilted with respect to the observation direction of the observation unit, that is, the optical axis of the irradiation unit is tilted with respect to the optical axis of the measurement unit.

On the other hand, as shown in FIG. 3, the following advantages can be obtained by making the irradiation direction of light from the irradiation unit form an angle of about 90°, that is, almost perpendicular, with respect to the direction of the main-scanning axis 308, that is, a direction perpendicular to the conveyance direction of a toner image. That is, streak flaws are sometimes formed on the surface of the image carrier of an image forming apparatus using the electrophotographic method in a direction along the sub-scanning axis 307 because of friction with a cleaning blade. If the irradiation direction of light from the irradiation unit forms an angle of about 90° with respect to the sub-scanning axis 307, light which irradiates such flaws tend to be regularly reflected, and hence normal diffuse reflection cannot be sometimes obtained. That is, even if a spot light beam irradiates the surface of the image carrier, the shape of the light spot reflected in the captured image obtained by the area sensor 305 may be distorted. This may degrade the detection accuracy of a light spot. In contrast to this, making the irradiation direction of light from the irradiation unit form an angle of about 90° with respect to the main-scanning axis 308 can prevent such degradation in detection accuracy. In an embodiment, in order to improve the measurement accuracy, light from the irradiation unit further enters the image carrier surface at a tilt. For example, the angle formed between light from the irradiation unit and the image carrier surface can be 60° or less.

Assume that the toner patch 108 has unevenness, when, for example, it is a halftone image, and the sampling frequency of the area sensor 305 is not sufficiently high. In this case, bright points appear at a plurality of positions corresponding to the unevenness on a reflection image. Even in such a case, it is possible to calculate the average thickness of the toner patch 108 by detecting the central position or the like of bright points on the image and detecting the difference between the detected central position and the position of a bright point when laser light enters the image carrier surface.

In an ideal state in which the measurement apparatus 107 and the image carrier are not vibrating, the thickness (or average thickness) of the toner patch 108 can be obtained as follows. In the following example, the thickness of the toner patch 108 is calculated based on the position of a bright point when laser light enters the toner patch 108 and the positions of bright points when laser light enters the image carrier surface before and after the toner patch.

Figure 4B:
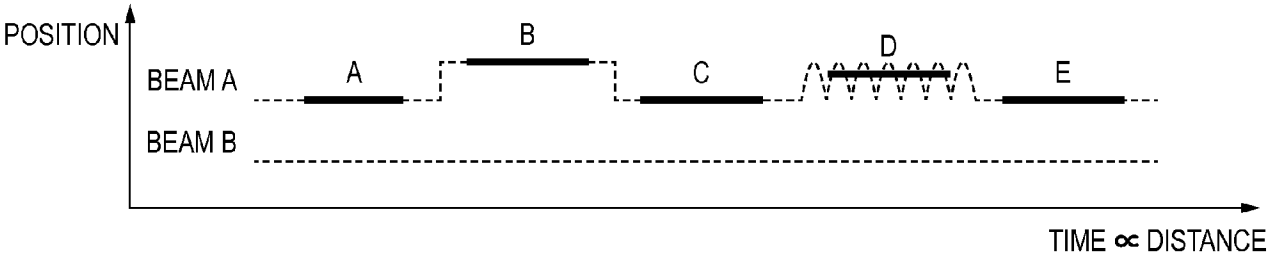

That is, the thickness of a toner patch 108A shown in FIG. 4B can be obtained by multiplying patch (108A) obtained according to equation (1) by a predetermined coefficient.

$$\text{patch}(108A)=B-(A+C)/2 \quad (1)$$

In addition, the thickness of the toner patch 108B shown in FIG. 4B can be obtained by multiplying patch (108B) obtained according to equation (2) by a predetermined coefficient.

$$\text{patch}(108B)=D-(C+E)/2 \quad (2)$$

In equations (1) and (2), A to E respectively indicate the positions of bright points along the sub-scanning axis 307 in the reflection images captured by the area sensor 305 when laser light enters positions A to E. Note that the toner patch 108B is a halftone image. D represents the barycenter of the positions of bright points along the sub-scanning axis 307 in a plurality of reflection images captured by the area sensor 305 when laser light enters the position D.

A method of calculating a toner amount in an ideal state in which the measurement apparatus 107 and the image carrier are not vibrating has been described above. However, the photosensitive drum and the transfer belt are vibrating because of, for example, rotation unevenness of the driving roller 401, which supports them, caused by its eccentricity and the like or fine vibrations transferred from another motor and the like. As is understood from FIG. 13B, when the position of the surface of the image carrier in a direction perpendicular to the surface of the image carrier varies, the position of the surface of the toner patch 108 in a direction perpendicular to the surface of the image carrier also varies. Consequently, the intersection point between the laser light 1301 and the surface of the toner patch 108 varies, resulting in variations in the position of the incident position 1303. As described above, because of the vibrations of the image carrier, the incident position of an emitted beam on the image carrier or the toner patch 108, that is, the incident position of the reflected beam on the area sensor 305, finely vibrates, as indicated by the solid line in FIG. 5.

On the other hand, beams A and B irradiate the surface of the image carrier or the surface of the toner patch 108 at nearby positions. For this reason, the incident position of reflected beam A on the area sensor 305 vibrates in the same manner as the incident position of reflected beam B on the area sensor 305. Therefore, data representing the incident positions of the emitted beams A and B on the image carrier or the toner patch 108, which are measured by the area sensor 305, contain similar noise components. The data representing the incident position of beam A on the toner patch 108 reflects the shape of the toner patch 108 as the original measurement target, in addition to these noise components. For this reason, calculating the difference between the incident position of beam A on the toner patch 108 and the incident position of beam B on the image carrier makes it possible to remove undulation and vibration components from the data and more accurately determine the shape of the toner patch 108.

In this embodiment, beams A and B irradiate positions separate from each other in a direction parallel to the main-scanning axis 308. That is, the irradiation positions of beams A and B in a direction along the sub-scanning axis 307 coincide with each other. In the embodiment, the axis of the driving roller 401 is parallel to the main-scanning axis 308, and the image carrier is driven while its planarity is maintained in the main-scanning direction. Even if, therefore, the image carrier vibrates, the incident positions of beams A and B on the image carrier or the toner patch 108 vibrate or undulate in the same manner (cause common-mode noise). In this embodiment, calculating a difference can more accurately remove undulation and vibration components from measurement data.

(Arrangement of Signal Processing Unit 306 and its Processing)

Figure 6A:
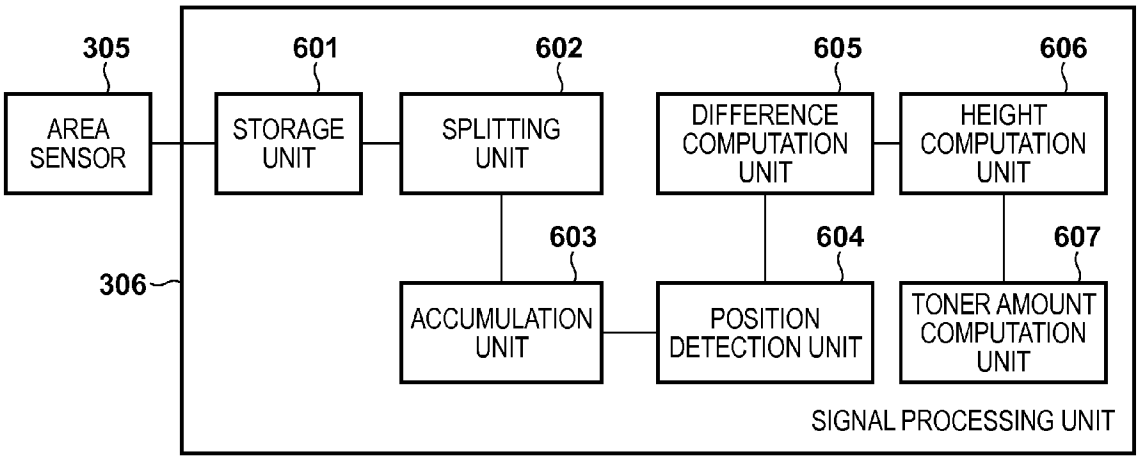
FIG. 6A shows the functional arrangement of a signal processing unit according to the first embodiment.

The functional arrangement of the signal processing unit 306 and toner amount calculation processing by the signal processing unit 306 will be described next with reference to FIG. 6A which is a block diagram showing the functional arrangement of the signal processing unit 306. The signal processing unit 306 includes a storage unit 601, a splitting unit 602, an accumulation unit 603, and a position detection unit 604. This detection unit measures the incident positions of light beams in a direction perpendicular to the surface of the image carrier based on the observation results obtained by the observation unit according to the above calculation method. More specifically, the detection unit detects the incident position of beam A measured by observing beam A entering the surface of the toner patch 108, and also detects the incident position of beam B measured by observing beam B entering the surface of the image carrier simultaneously with beam A. The signal processing unit includes a calculation unit constituted by a difference computation unit 605, a height computation unit 606, and a toner amount computation unit 607. This calculation unit calculates the thickness of the toner patch 108 based on the incident positions of beams A and B detected by the detection unit.

The storage unit 601 stores the reflection images captured by the area sensor 305. The area sensor 305 continuously captures reflection images in accordance with a sampling frequency. The storage unit 601 saves these images in chronological order.

The splitting unit 602 splits each reflection image stored in the storage unit 601 into a plurality of image regions in accordance with the positions and number of laser light beams. This embodiment uses two laser light beams, namely, beam A and beam B. The splitting unit 602 splits a reflection image into a region where beam A is reflected and a region where beam B is reflected by referring to the positions of beams A and B. The reflection image in 6*b* in FIG. 6B is split along a split line into a region where beam A enters and a region where beam B enters.

The detection unit constituted by the accumulation unit 603 and the position detection unit 604 detects the incident position of beam A in a direction perpendicular to the surface of the image carrier by detecting the position of beam A in the region where beam A is reflected. The detection unit also detects the incident position of beam B in a direction perpendicular to the surface of the image carrier by detecting the position of beam B in the region where beam B is reflected.

More specifically, the accumulation unit 603 accumulates the pixel values of the respective pixel arrays in the main-scanning direction in the respective regions. In this manner, the accumulation unit 603 obtains a light amount distribution representing the relationship between positions in the sub-scanning direction and light amounts in each region. In FIG. 6B, 6*c* indicates a light amount distribution in each region. In this embodiment, since beam A and beam B are laser light spots, each light amount distribution obtained by the accumulation unit 603 has a bell shape. The accumulation unit 603 performs the processing of generating a light amount distribution with respect to each of continuously captured reflection images.

Figure 6B:
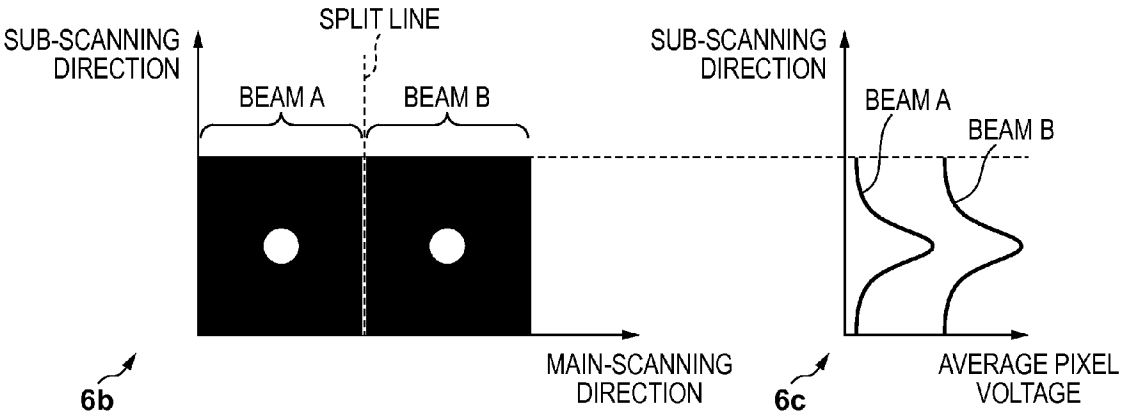
FIG. 6B shows an example of a reflection image captured according to the first embodiment.
Figure 7:
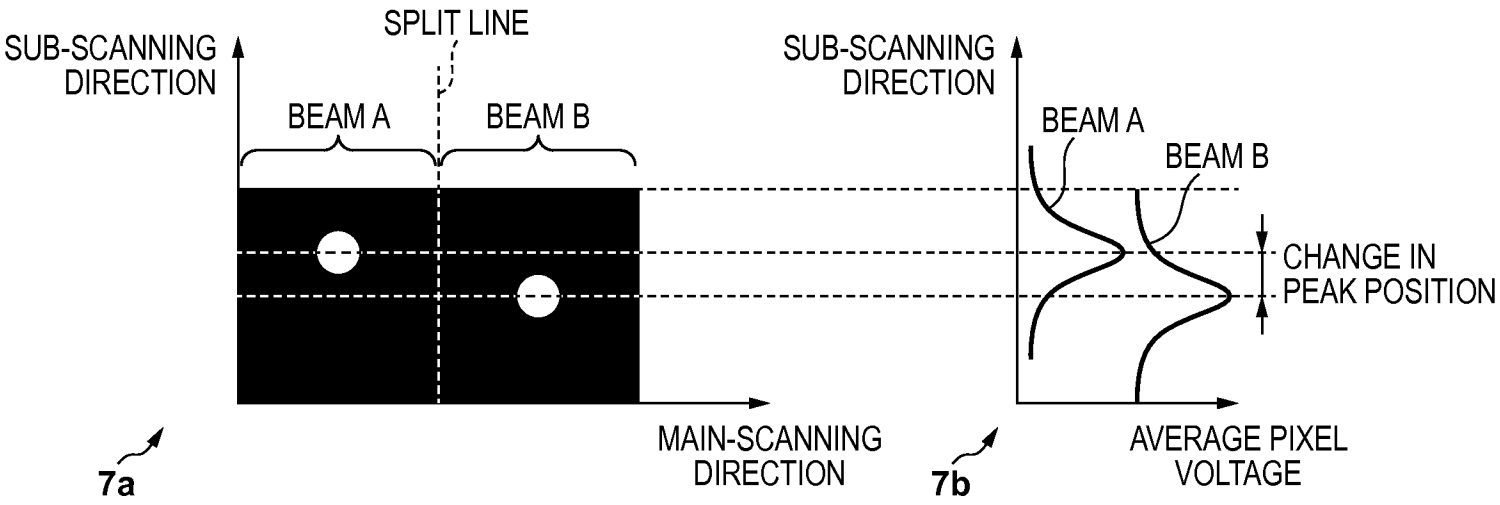
FIG. 7 shows an example of a reflection image captured according to the first embodiment.

FIG. 6B shows a case in which both beam A and beam B irradiate the image carrier. Therefore, the incident position of reflected beam A almost coincides with that of reflected beam B. On the other hand, 7*a* in FIG. 7 indicates the reflection images obtained when beam A irradiates the toner patch 108 and beam B irradiates the image carrier. Reflected beam A is formed into an image at a position on the area sensor 305 which is shifted from the position beam A irradiating the image carrier by a distance corresponding to the thickness of the toner patch 108. For this reason, the position of the light spot on the reflection image moves in the sub-scanning direction. In FIG. 7, 7*b* indicates the light amount distributions in the respective regions which are obtained from the reflection images in 7*a* in FIG. 7. As indicated by 7*b* in FIG. 7, the light amount distribution also shifts in the sub-scanning direction by a distance corresponding to the thickness of the toner patch 108. This makes it possible to measure the thickness of the toner patch 108 based on the positions of the light amount distributions, for example, the peak positions of the light amount distributions.

A method of detecting a peak position from light amount distribution data is not specifically limited. For example, it is possible to detect a peak position by performing fitting with a function by the least squares method. For example, there is available a method of predicatively computing a peak position by performing curve fitting using a Gaussian function. A Gaussian function is a function having a bell shape peak with x=μ being the center, as indicated by equation (3). A parameter μ obtained by fitting represents the peak position of a waveform. It is possible to perform fitting with a function other than a Gaussian function, such as the Lorenz function represented by equation (4) or the quadratic function represented by equation (5). Another embodiment may be configured to detect a position at which the maximum light amount is obtained as a peak position or calculate the barycenter of a light amount distribution as a peak position instead of a peak position detected by fitting.

$$f(x) = \frac{A}{\sqrt{2\pi\sigma^2}}\exp\left\{-\frac{(x-\mu)^2}{2\sigma^2}\right\} + C \tag{3}$$

$$f(x) = \frac{2A}{\pi}\cdot\frac{w}{4(x-x_c)^2+w^2} + C \tag{4}$$

$$f(x) = A(x-B)^2 + C \tag{5}$$

Figure 5:
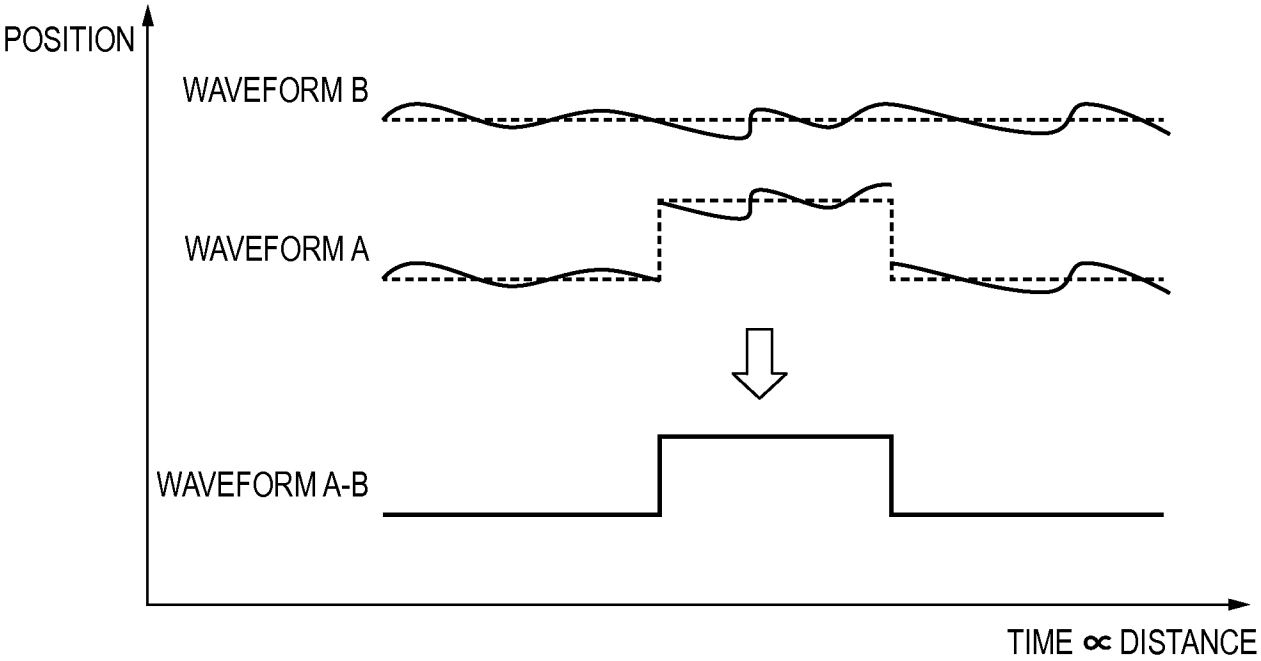
FIG. 5 is a view for explaining a method of measuring the thickness of a toner patch by difference computation.

The position detection unit 604 detects the peak position of a light amount distribution in each region generated by the accumulation unit 603. The position detection unit 604 performs the processing of detecting a peak position with respect to each of continuously captured reflection images. In this manner, the position detection unit 604 detects the incident positions of reflected beam A and reflected beam B on the area sensor 305 in the sub-scanning direction for each reflection image. Waveforms A and B shown in FIG. 5 are obtained by plotting the time (or the moving distance of the image carrier) and the incident positions of reflected beams A and B on the area sensor 305 in the sub-scanning direction. A waveform obtained in this manner will be referred to as beam A profile (sectional shape) data or beam B profile data hereinafter. This profile data represents a temporal change in the incident position of beam A or beam B on the surface of the image carrier or toner patch 108. In another embodiment, profile data may represent the time (or the moving distance of the image carrier) and the incident position of beam A or B on the surface of the image carrier of toner patch 108 in a direction perpendicular to the surface of the image carrier. As described above, it is possible to calculate the incident position of laser light on the surface of the image carrier or toner patch 108 in a direction perpendicular to the surface of the image carrier from the incident position of laser light on the area sensor 305.

The difference computation unit 605 calculates the difference between profile data. More specifically, the difference computation unit 605 calculates the difference (waveform A−B) between the profile data of beam A and the profile data of beam beam. Waveform A−B obtained in this manner reflects the shape of the toner patch 108, but noise caused by vibration or undulation is removed from the waveform. The height computation unit 606 calculates the thickness of the toner patch 108 by using waveform A−B calculated by the difference computation unit 605 according to equation (1) or (2). Using waveform A−B from which noise is removed can accurately calculate the shape of the toner patch 108. The toner amount computation unit 607 converts the obtained thickness of the toner patch 108 into a toner density, toner volume, or the like, as needed. The thickness (toner amount) of the toner patch, the toner density, the toner volume, or the like calculated in this manner is used for control of each process.

However, it is not essential to calculate a profile representing a temporal change in incident position. For example, it is possible to calculate the difference between a measurement value representing the incident position of beam A on the surface of the toner patch 108 and a simultaneously obtained measurement value representing the incident position of beam B on the surface of the image carrier. It is also possible to calculate the thickness of the toner patch 108 based on the difference between this difference and a predetermined value representing the difference between the incident positions of beams A and B on the surface of the image carrier.

Figure 8:
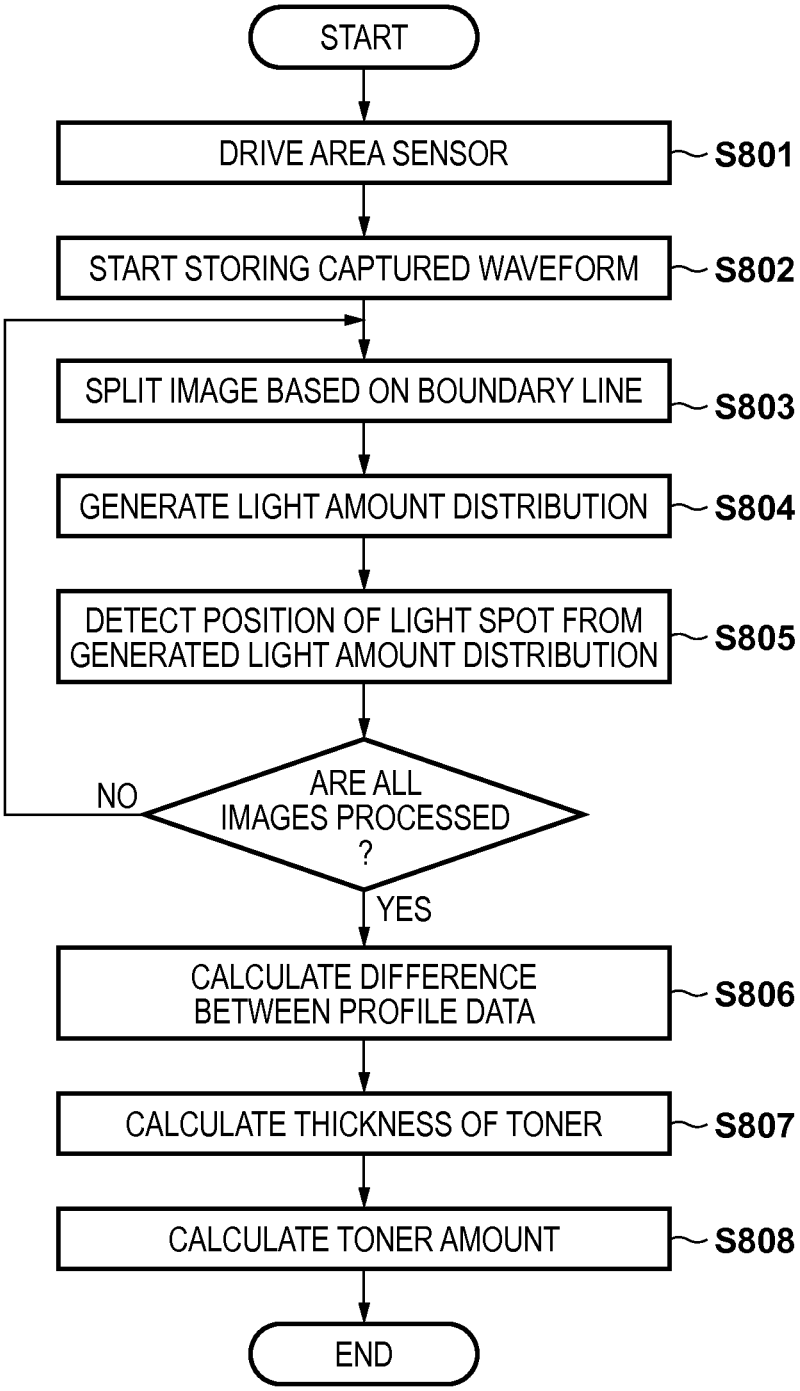
FIG. 8 is a flowchart of processing performed according to the first embodiment.

The processing performed by the signal processing unit 306 will be described below with reference to the flowchart of FIG. 8. In step S801, the area sensor 305 starts image capturing. The area sensor continuously performs image capturing in accordance with a designated sampling frequency. In step S802, the storage unit 601 starts storing the reflection image captured by the area sensor 305 after the toner patch 108 is formed on the image carrier before beam A enters the toner patch 108. The area sensor 305 performs image capturing and the storage unit 601 performs storage until the toner patch 108 as a measurement target passes through the incident position of beam A.

From step S803, the obtained reflection image is processed. Processing from step S803 may be performed after the completion of image capturing by the area sensor 305 and storage by the storage unit 601. In addition, processing from step S803 may be performed for a reflection image already stored in the storage unit 601 while image capturing by the area sensor 305 and storage by the storage unit 601 are continued.

In step S803, the splitting unit 602 splits the reflection image into a plurality of regions in the above manner. In step S804, the accumulation unit 603 generates a light amount distribution in each region, as described above. In step S805, the position detection unit 604 detects the peak position of each light amount distribution in the above manner. The processing in steps S803 to S805 is performed for all the reflection images stored in the storage unit 601. That is, after step S805, it is determined whether all the reflection images have been processed. If not all the reflection images have been processed, the process returns to step S803 to perform processing for the next reflection image. In contrast to this, if all the reflection images have been processed, the process advances to step S806.

In step S806, the difference computation unit 605 calculates the difference between profile data in the above manner to remove vibration components and undulation components from the profile data. In step S807, the height computation unit 606 calculates the thickness of the toner patch 108 by using the difference calculated by the difference computation unit 605 in the above manner. In step S808, the toner amount computation unit 607 executes toner amount computation based on the calculated toner height.

Second Embodiment

In the first embodiment, a plurality of laser light beams are obtained by splitting laser light from the laser light source 301 having one emission point by using the diffraction grating 303. In the second embodiment, a plurality of laser light beams are obtained by using a laser light source having a plurality of emission points.

Figure 9:
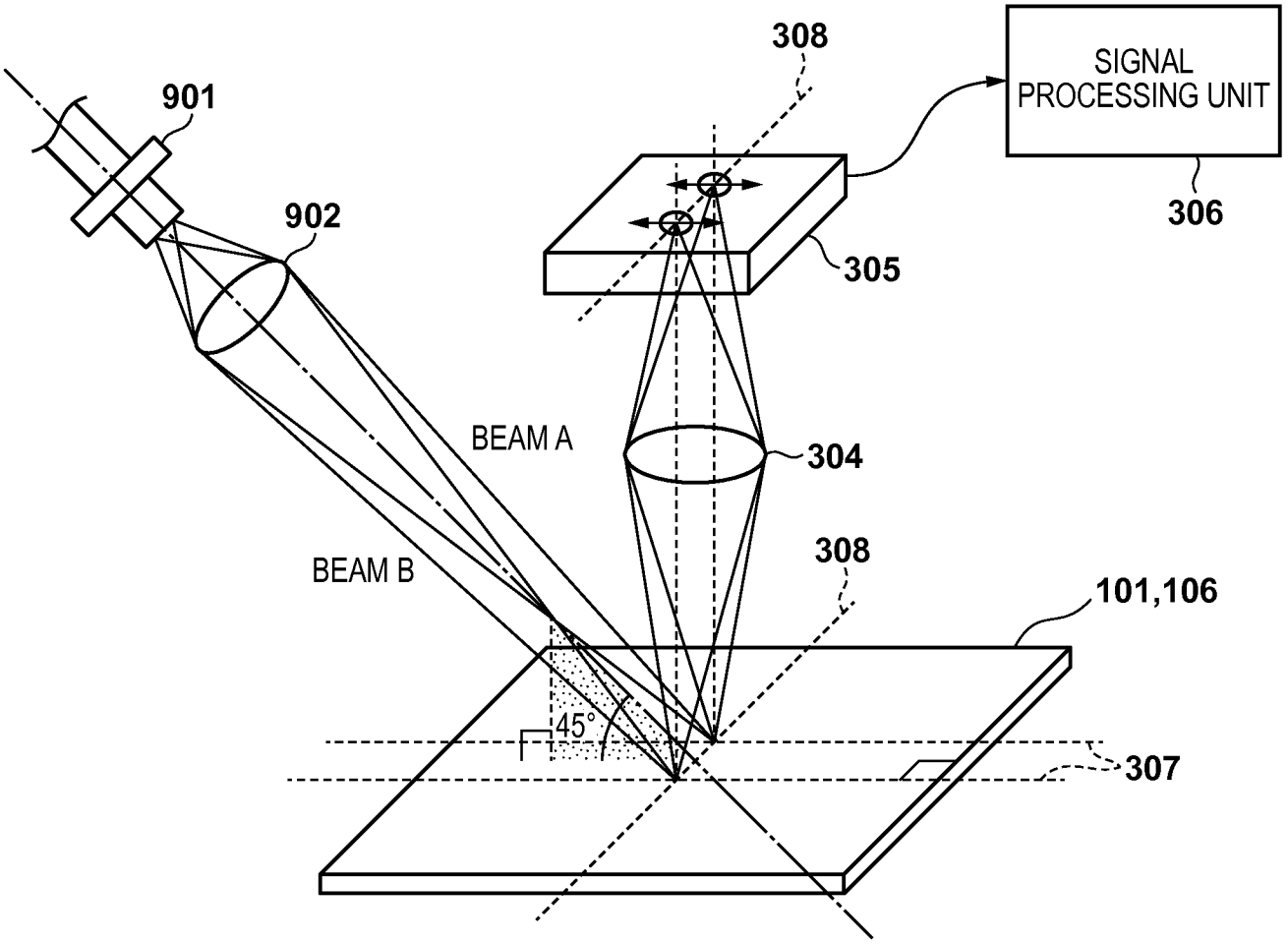
FIG. 9 is a view showing an example of the arrangement of a measurement apparatus according to the second embodiment.
Figure 10A:
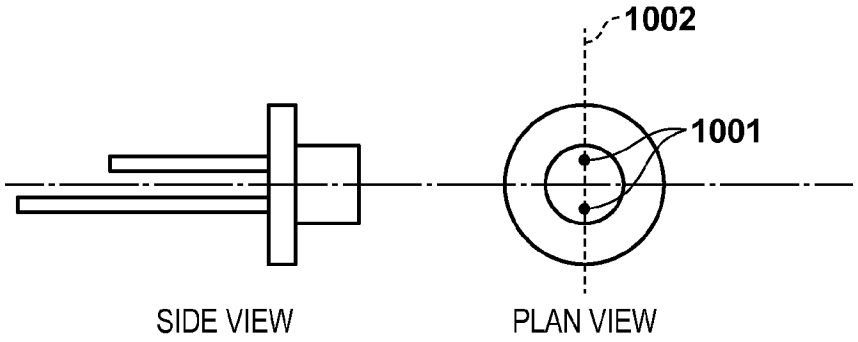
FIGS. 10A and 10B are views showing an example of an irradiation optical system used in the second embodiment.
Figure 10B:
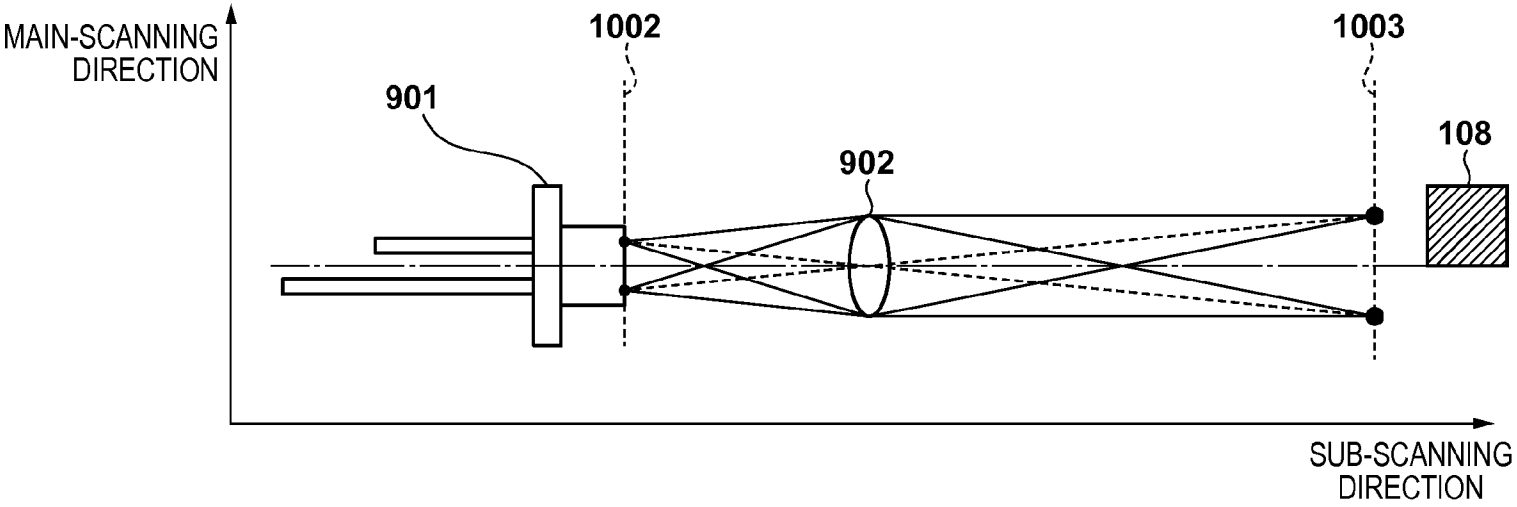

The second embodiment will be described below with reference to FIGS. 9, 10A, and 10B showing an example of the arrangement of a measurement apparatus 107 according to this embodiment. The arrangement of an image forming apparatus according to this embodiment is similar to that according to the first embodiment, and the same reference numerals denote the same components. A description of the same components as those in the first embodiment will be omitted.

The first embodiment uses three devices, namely, the laser light source 301, the condenser lens 302, and the diffraction grating 303. In contrast to this, as shown in FIG. 9, the second embodiment uses two devices, namely, a laser light source 901 and a condenser lens 902. This can omit a diffraction grating and obviates the necessity to adjust the mounting position of the diffraction grating. It is therefore possible to reduce the manufacturing cost of an image forming apparatus. In addition, reducing the number of components constituting the optical system can easily improve the accuracy of the irradiation position of laser light by adjusting the mounting positions of components such as the laser light source 901 and the condenser lens 902.

FIGS. 10A and 10B show the detailed arrangement and placement of the laser light source 901 and the condenser lens 902. In this embodiment, the laser light source 901 is a multi-emission-point light source, that is, a laser light source having a plurality of emission points and capable of emitting a plurality of laser light beams. For example, the laser light source 901 can be a multi-emission-point laser diode. As shown in FIG. 10A, the laser light source 901 has two emission points 1001. In this case, an emission point axis 1002 passing through the two emission points 1001 is defined. As shown in FIG. 10B, the housing of the laser light source 901 is installed such that the emission point axis 1002 becomes parallel to a main-scanning axis 308. As a result, an irradiated point axis 1003 passing through two spots formed on the image carrier through the condenser lens 902 also becomes parallel to the main-scanning axis 308. This placement makes it possible to emit two laser light beams such that two spot light beams are juxtaposed along the main-scanning axis 308 as in the first embodiment.

Third Embodiment

In the first and second embodiments, the image carrier and the toner patch 108 each are irradiated with one laser light beam. In the third embodiment, the image carrier and a toner patch 108 each are irradiated with two or more laser light beams to more accurately detect the thickness of the toner patch 108.

Figure 11A:
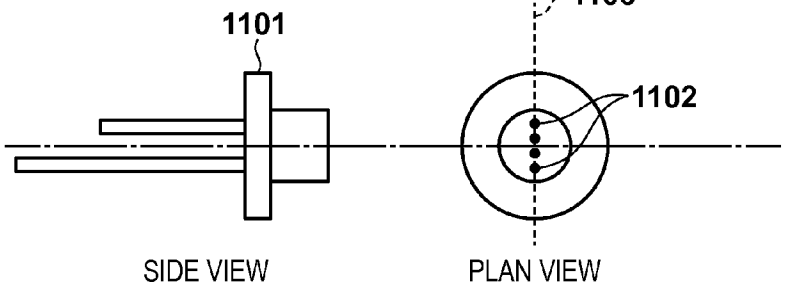
FIGS. 11A and 11B are views showing an example of an irradiation optical system used in the third embodiment.
Figure 11B:
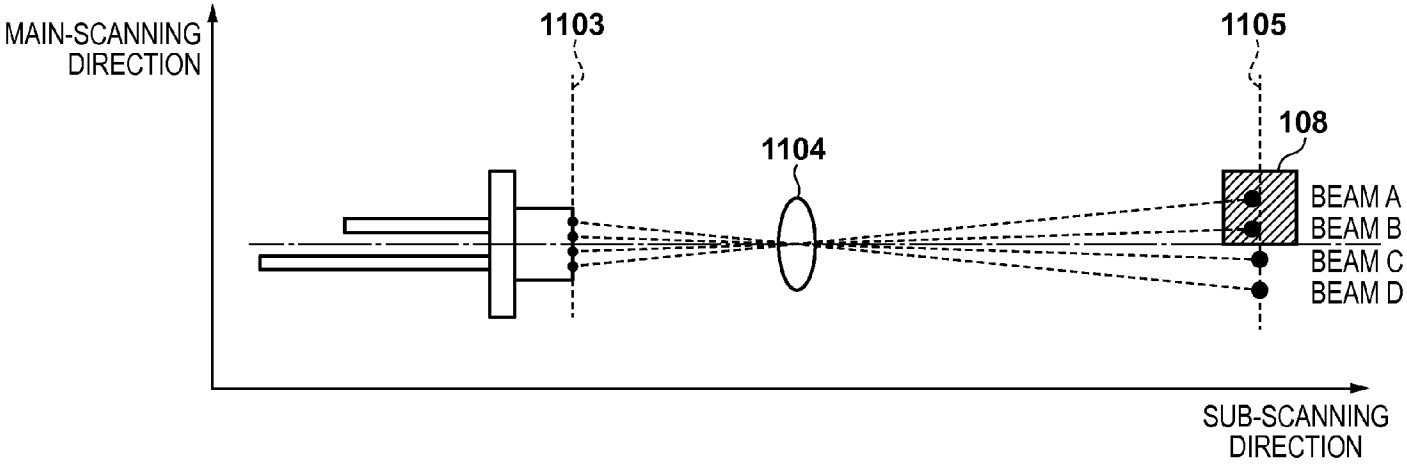
Figure 12:
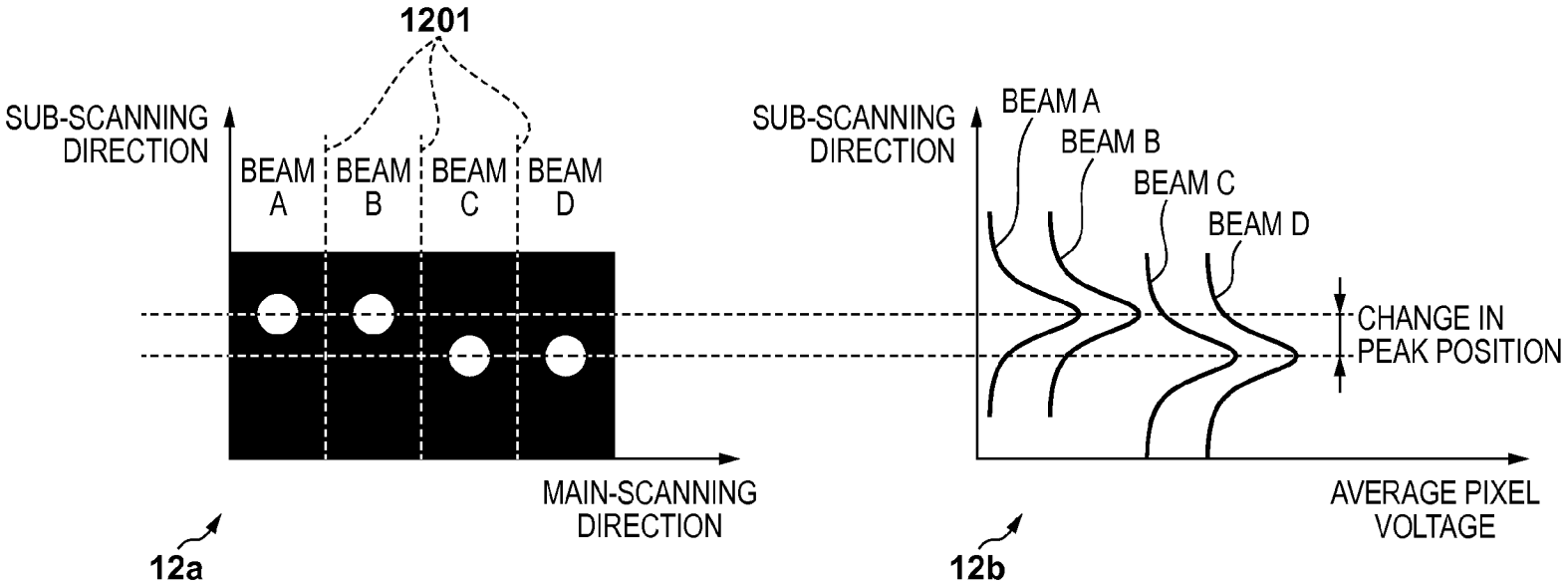
FIG. 12 shows an example of a reflection image captured according to the third embodiment.

The third embodiment will be described below with reference to FIGS. 11A, 11B, and 12 showing an example of the arrangement of a measurement apparatus 107 according to this embodiment. The arrangement of an image forming apparatus according to this embodiment is similar to that according to the first embodiment, and the same reference numerals denote the same components. A description of the same components as those in the first embodiment will be omitted.

As shown in FIG. 11A, a laser light source 1101 used in this embodiment is a multi-emission-point laser diode having four emission points 1102. In this case, an emission point axis 1103 passing through the four emission points 1102 is defined. As shown in FIG. 11B, the housing of the laser light source 1101 is installed such that the emission point axis 1103 becomes parallel to a main-scanning axis 308, as in the second embodiment. Four laser light beams enter the image carrier through a condenser lens 1104. At this time, an irradiated axis 1105 passing through the four spot light beams formed on the image carrier becomes parallel to the main-scanning axis 308.

In this embodiment, the position of the toner patch 108 formed on the image carrier is adjusted such that two (beams A and B) of laser light beams can enter the toner patch 108, and the remaining two (beams C and D) of the laser light beams always enter the image carrier. An area sensor 305 measures the reflected light beams of the four laser light beams emitted in this manner. In other words, the area sensor 305 captures reflection images including the light spots obtained by the four laser light beams. Thereafter, a signal processing unit 306 performs image processing for the reflection images in accordance with the flowchart shown in FIG. 8.

Part of the processing performed by the signal processing unit 306 which differs from the first embodiment will be described with reference to FIG. 12. FIG. 12 shows reflection images and light amount distributions when beams A and B irradiate the toner patch 108. In this embodiment, a splitting unit 602 splits the reflection image obtained by the area sensor 305 into four regions along split lines 1201. As indicated by 12*a* in FIG. 12, the respective split regions include spot light beam images formed by beams A to D.

An accumulation unit 603 performs the same processing as that in the first embodiment with respect to the respective split regions to obtain the light amount distributions indicated by 12*b* in FIG. 12. As indicated by 12*b* in FIG. 12, the peak positions of beams A and B are shifted from those of beams C and D. A position detection unit 604 detects peak positions from the respective reflection images captured in chronological order, thereby obtaining profile data concerning beams A to D.

A difference computation unit 605 averages the profile data (waveforms C and D) concerning beams C and D containing noise components caused by the vibration or undulation of the image carrier. The difference computation unit 605 also averages the profile data (waveforms A and D) concerning beams A and D reflecting the shape of the toner patch 108 and containing noise components. The difference computation unit 605 then calculates a difference ((A+B)/2−(C+D)/2) between the two profile data obtained by averaging. Thereafter, a height computation unit 606 calculates the thickness of the toner patch by using the difference calculated by the difference computation unit 605.

According to this embodiment, assuming that the sampling frequency of the area sensor 305 remains the same, the difference data used to calculate the thickness of a toner patch is calculated by using data twice in amount that in the first embodiment. This makes it possible to further reduce the amount of high-frequency noise mixed in data.

This embodiment has exemplified the case in which four laser light beams are emitted. However, the number of laser light beams may be three or five or more. In addition, in the embodiment, the number of laser light beams which enter a toner patch is equal to the number of laser light beams which do not enter the toner patch. However, the number of laser light beams which enter a toner patch may differ from the number of laser light beams which do not enter the toner patch depending on the surface state of the image carrier or the reflection characteristic and the like of the toner patch surface. For example, the ratio between the numbers of such laser light beams may be 1:3 or 3:1.

In another embodiment, beams A to F arrayed in a direction along the main-scanning axis 308 are emitted. In this case, the toner patch 108 is arranged such that while beams C and D irradiate the toner patch 108, beams A, B, E, and F irradiate the image carrier. In this case, it is possible to correct waveform C obtained concerning beam C by using waveforms A and B obtained concerning beams A and B. It is also possible to correct waveform D obtained concerning beam D by using waveforms E and F concerning beams E and F. More specifically, the difference computation unit 605 can calculate the difference (C−(A+B)/2) between waveform C and waveforms A and B, and the difference (D−(E+F)/2) between waveform D and waveforms E and F. This embodiment is effective when the toner patch 108 has regions with different heights. That is, since the measurement result at each light spot on the toner patch 108 can be corrected by using the measurement results at adjacent light spots on the image carrier, the measurement accuracy can be improved.

Fourth Embodiment

In the first to third embodiments, the area sensor 305 is arranged such that the array directions of the pixels on the area sensor 305 respectively coincide with the main-scanning axis 308 and the sub-scanning axis 307. In the fourth embodiment, an area sensor 305 is arranged such that the array directions of the pixels on the area sensor 305 are respectively tilted with respect to a main-scanning axis 308 and a sub-scanning axis 307. That is, each side of a rectangular capturing range on the image carrier, which is formed by the area sensor 305, is tilted with respect to the main-scanning axis 308 and the sub-scanning axis 307. The following, in particular, will exemplify a case in which the area sensor 305 is arranged such that the array directions of the pixels on the area sensor 305 respectively form an angle of about 45° with the main-scanning axis 308 and the sub-scanning axis 307.

The arrangement of an image forming apparatus according to the fourth embodiment is similar to that of the image forming apparatuses according to the first to third embodiments, and the same reference numerals denote the same components. A description of the same components as those in the first to third embodiments will be omitted. The following will exemplify a case in which four laser light beams are emitted, as in the third embodiment. However, the number of laser light beams may be two or another number.

Figure 14:
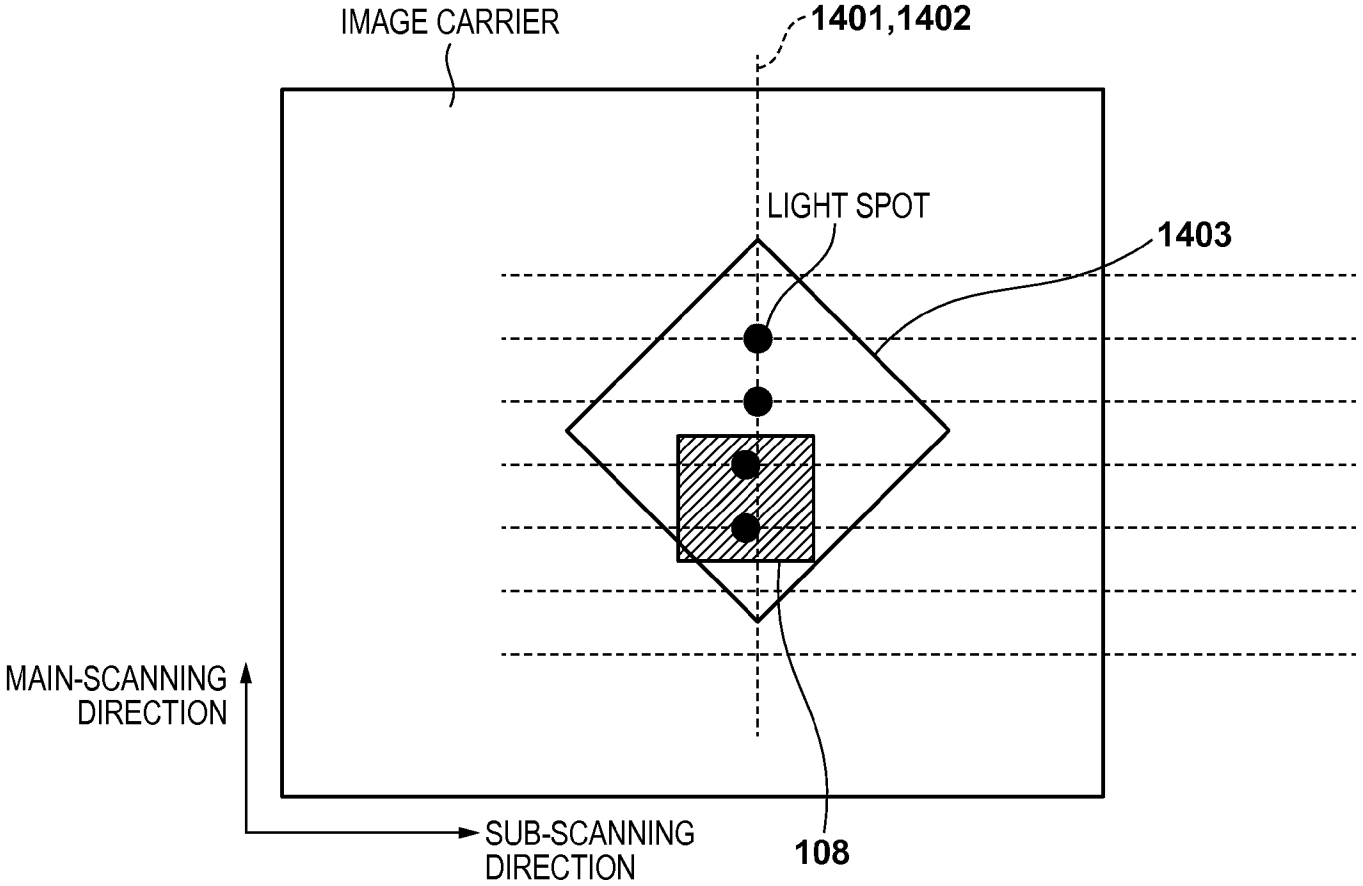
FIG. 14 is a view showing the capturing range of an area sensor according to the fourth embodiment.

FIG. 14 shows the relationship between the incident positions of laser light beams on the image carrier and the capturing range formed by the area sensor 305. An irradiated axis 1401 is an axis passing through the light spots formed on the image carrier by laser light beams. In this embodiment, the area sensor 305 is arranged such that a diagonal axis 1402 of a capturing range 1403 formed by the area sensor 305 is parallel to the irradiated axis 1401. That is, the area sensor 305 is arranged such that a diagonal direction of the image sensor of the square area sensor 305 is parallel to the irradiated axis 1401. A signal processing unit 306 performs image processing similar to that in the third embodiment with respect to the reflection image captured by the area sensor 305 arranged in this manner.

Figure 15:
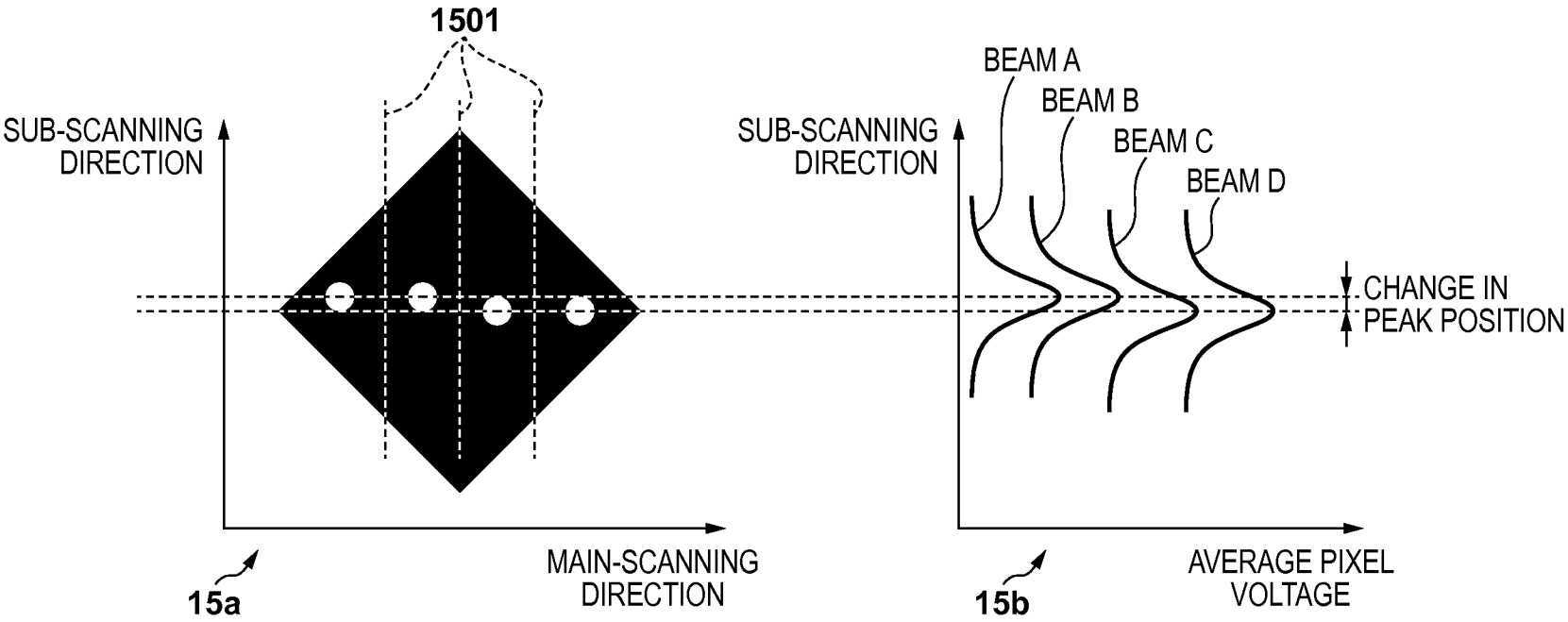
FIG. 15 shows an example of a reflection image captured according to the fourth embodiment.

Part of the processing performed by the signal processing unit 306 which differs from the third embodiment will be described below with reference to FIG. 15. In this embodiment, a splitting unit 602 splits the reflection image obtained by the area sensor 305 into four regions along split lines 1501. An accumulation unit 603 generates a light amount distribution representing the relationship between positions in the sub-scanning direction and light amounts by accumulating pixel values in a direction parallel to the main-scanning axis 308 in each region. In this case, since the array direction of the pixels is tilted at about 45° with respect to the main-scanning axis 308, it is possible to accumulate pixel values in a direction parallel to the main-scanning axis 308 by accumulating pixel values of pixels on an axis tilted at about 45° with respect to the array direction of the pixels.

The thickness of a toner patch 108 is calculated by making a position detection unit 604, a difference computation unit 605, and a height computation unit 606 perform the same processing as that in the third embodiment using the obtained light amount distribution.

According to this embodiment, even if the range irradiated with each laser beam is longer than one side of the capturing range of the area sensor 305, it is possible to observe reflected light of each laser light beam. As described above, since it is possible to use the area sensor 305 having a light-receiving surface smaller than that in the third embodiment, it is possible to reduce the manufacturing cost of the image forming apparatus 100.

Fifth Embodiment

According to the first and second embodiments, the toner patch 108 is formed on the image carrier such that beam A enters the toner patch 108 and beam B simultaneously enters the image carrier. However, owing to the influences of the mounting error and the like of the measurement apparatus 107, the incident position of a laser light beam emitted from the laser light source 301 onto the image carrier (the position of a light spot) differs for each image forming apparatus 100. In general, since the nearer the incident positions of two laser light beams, the more similar the influences of the vibration or undulation on two laser light beams, it is possible to accurately remove vibration components or undulation components from profile data by calculating the difference between the profile data. However, owing to the error between the incident positions of laser light beams, as the positions of the two light spots come closer to each other, it is more difficult to form the toner patch 108 so as to pass through one light spot while not passing through the other light spot.

In the fifth embodiment, a specific position detection patch is formed on the image carrier, and the irradiation position of laser light on the image carrier is detected by measuring the size of the position detection patch using a measurement apparatus 107. Using this result facilitates forming a toner patch 108 so as to pass through one light spot while not passing through the other light spot. More specifically, a measurement toner image whose length in the conveyance direction of the toner image differs in accordance with a position in a direction perpendicular to the conveyance direction of the toner image is used as a position detection patch.

Figure 16:
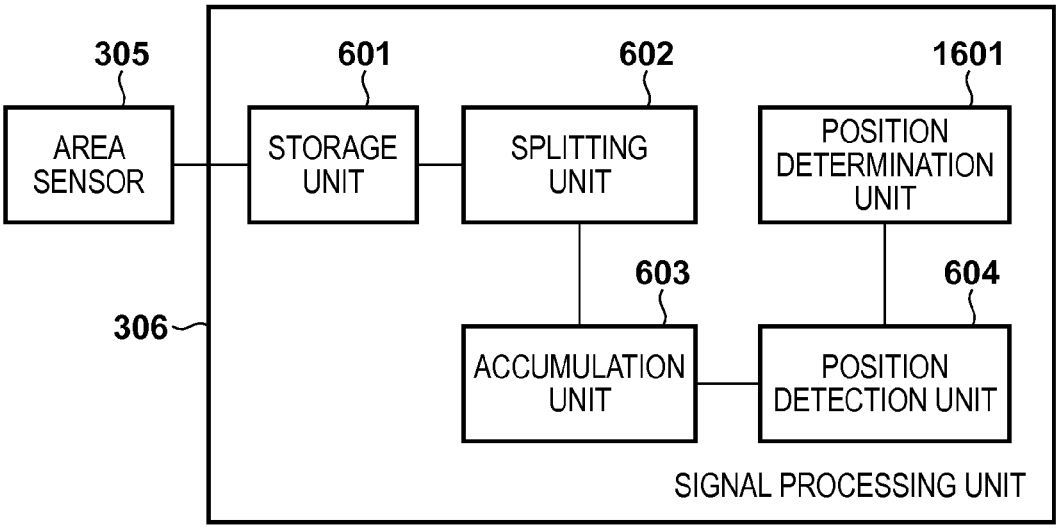
FIG. 16 is a block diagram showing the functional arrangement of a signal processing unit according to the fifth embodiment.

The arrangement of an image forming apparatus according to the fifth embodiment is similar to that of the image forming apparatuses according to the first and second embodiments, and the same reference numerals denote the same components. A description of the same components as those in the first and second embodiments will be omitted. FIG. 16 shows the arrangement of a signal processing unit 306 according to this embodiment. The measurement apparatus 107 includes a storage unit 601, a splitting unit 602, an accumulation unit 603, and a position detection unit 604, as in the first embodiment. The measurement apparatus 107 further includes a position determination unit 1601. In the embodiment, there is no need to use the difference computation unit 605, the height computation unit 606, and the toner amount computation unit 607 to detect a light spot. These components are therefore omitted from FIG. 16.

Figure 17A:
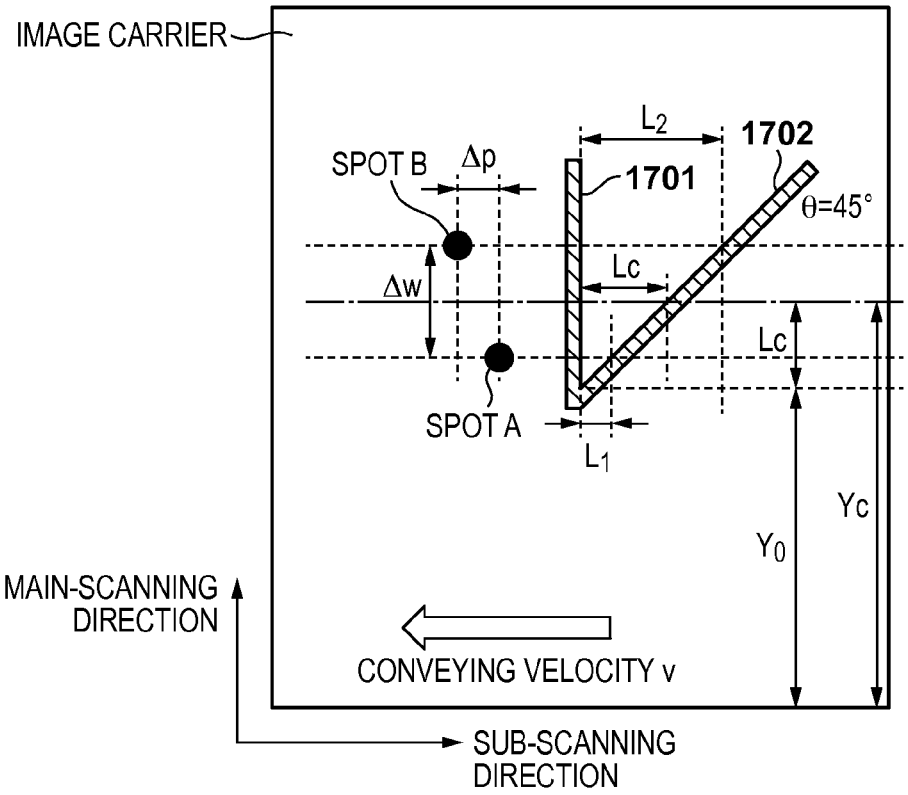
FIGS. 17A and 17B are views showing an example of a position detection patch used in the fifth embodiment.
Figure 17B:
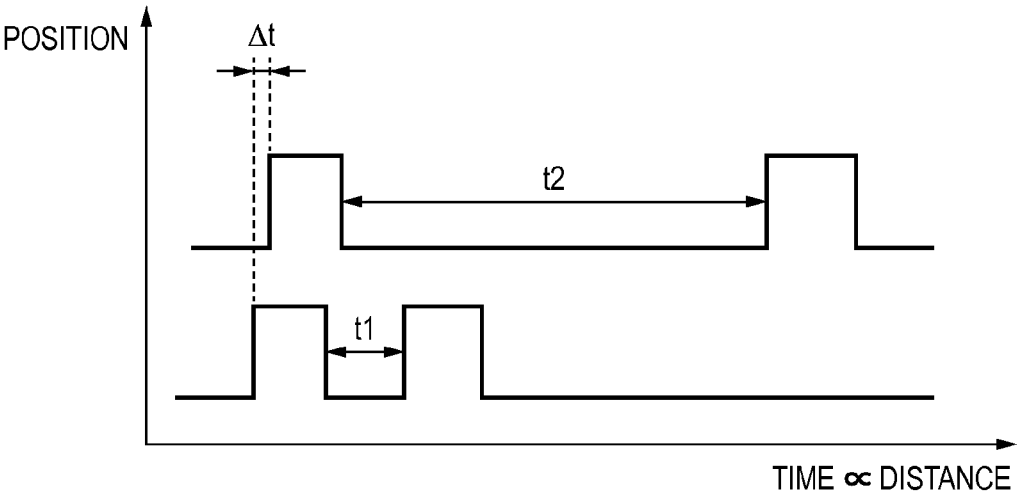

The principle of detecting light spots in this embodiment will be described with reference to FIGS. 17A and 17B. The embodiment is configured to detect the positions of two light spots by measuring a position detection patch. The position detection patch includes a first edge 1701 parallel to a main-scanning axis 308 (perpendicular to a sub-scanning axis 307) and a second edge 1702 tilted with respect to the main-scanning axis 308 and the sub-scanning axis 307. As shown in FIG. 17, the length of the graphic pattern constituted by the first edge 1701 and the second edge 1702 in the conveyance direction of a toner image differs in accordance with a position in a direction perpendicular to the conveyance direction of the toner image. It is therefore possible to detect the position of a light spot in a direction perpendicular to the conveyance direction of the toner image by measuring the length of this graphic pattern in the conveyance direction of the toner image at the position of the light spot.

In this embodiment, the first edge 1701 is continuous with the second edge 1702. The size of the position detection patch is set to be large enough to make both the first edge 1701 and the second edge 1702 pass through two light spots, even in the presence of an error in the mounting position of the measurement apparatus 107. Assume that in the following description, $Y_0$ represents the position of a point O of intersection between the first edge 1701 and the second edge 1702 along the main-scanning axis 308, and a conveying velocity V of the image carrier is constant.

The measurement apparatus 107 acquires profile data concerning two beams when the position detection patch passes through two light spots. More specifically, an area sensor 305 continuously performs image capturing, and the storage unit 601, the splitting unit 602, the accumulation unit 603, and the position detection unit 604 process the obtained reflection image, thereby obtaining profile data. FIG. 17 shows an example of profile data concerning beams A and B.

In this embodiment, as in the first embodiment, profile data represent the relationships between the time (or the moving distance of the image carrier) and the incident positions of reflected beams A and B on the area sensor 305 in the sub-scanning direction. However, in another embodiment, profile data may represent the relationships between the time (or the moving distance of the image carrier) and the light amounts of reflected beams A and B. It is possible to calculate light amounts from the light amount distributions of reflected beams A and B by a known method such as fitting using a function such as a Gaussian function. The amount of reflected light of laser light when it enters a toner patch differs from that when it enters the image carrier. It is therefore possible to determine by using such profile data whether laser light has entered a toner patch or the image carrier at a predetermined time. That is, it is also possible to calculate the time from the instant the first edge 1701 passes through a light spot to the instance the second edge 1702 reaches the light spot.

The position determination unit 1601 refers to profile data concerning two laser light beams and calculates the time from the instant the first edge 1701 passes through each light spot to the instant the second edge 1702 reaches the light spot. More specifically, the position determination unit 1601 calculates a time $t_1$ from the instant the first edge 1701 passes through light spot A formed by beam A to the instant the second edge 1702 reaches light spot A. FIG. 17 shows the time $t_1$.

For example, the position determination unit 1601 can calculate, as the time $t_1$, the time from the instant the incident position of reflected beam A on the area sensor 305 returns to a predetermined range to the instant the incident position shifts from the predetermined range. This predetermined range is set in advance as a range, on the area sensor 305, where reflected laser light enters when it enters the image carrier. The position determination unit 1601 also calculates a time $t_2$ from the instant the first edge 1701 passes through light spot B formed by beam B to the instant the second edge 1702 reaches light spot B in the same manner as described above. Note that in this embodiment, the single area sensor 305 observes reflected laser light beams. That is, since the same area sensor 305 observes changes in the incident positions of light spots A and B on the area sensor 305, it is possible to accurately measure the times $t_1$ and $t_2$. The times $t_1$ and $t_2$ obtained in this manner represent the positions of light spots A and B in a direction perpendicular to the conveyance direction of a toner image.

A specific method of calculating the position of a midpoint between light spots A and B in a direction perpendicular to the conveyance direction of a toner image will be described below. The position determination unit 1601 calculates a moving distance $L_1$ of a position detection patch from the instant the first edge 1701 passes through light spot A to the instant the second edge 1702 reaches light spot A according to equation of $L_1=v\cdot t_1$. Likewise, the position determination unit 1601 calculates a moving distance $L_2$ of the position detection patch from the instant the first edge 1701 passes through light spot B to the instant the second edge 1702 reaches light spot B according to equation of $L_2=v\cdot t_2$. It is then possible to calculate a moving distance Lc of the position detection patch from the instant the first edge 1701 passes through the midpoint between light spot A and light spot B to the instant the second edge 1702 reaches the midpoint according to equation of $Lc=(L_1+L_2)/2$. Since the second edge 1702 is tilted at about 45° with respect to the main-scanning axis 308 and the sub-scanning axis 307, the distance between the point O of intersection between the first edge 1701 and the second edge 1702 and the midpoint between light spot A and light spot B in a direction along the main-scanning axis 308 is represented by Lc. Therefore, a position Yc of the midpoint between light spot A and light spot B along the main-scanning axis 308 can be calculated according to equation of $Yc=Y_0+Lc$.

If light spots A and B are shifted from each other by Δp along the sub-scanning axis 307 because of the shift of the installation position of the measurement apparatus 107, the timings at which the first edge 1701 passes through light spots A and B are shifted from each other by $\Delta t=\Delta p/v$. However, the times $t_1$ and $t_2$ do not change in accordance with Δt and Δp, the calculated position Yc does not contain any errors caused by Δp and Δt. Therefore, according to this embodiment, even if the positions of light spots A and B in a direction along the sub-scanning axis 307 are shifted from each other, the position Yc can be accurately calculated. In addition, according to the embodiment, even if an interval Δw between light spots A and B differs from a design value because of the shift between the positions of light spots A and B in a direction along the main-scanning axis 308, it is possible to accurately calculate the position Yc.

Figure 18:
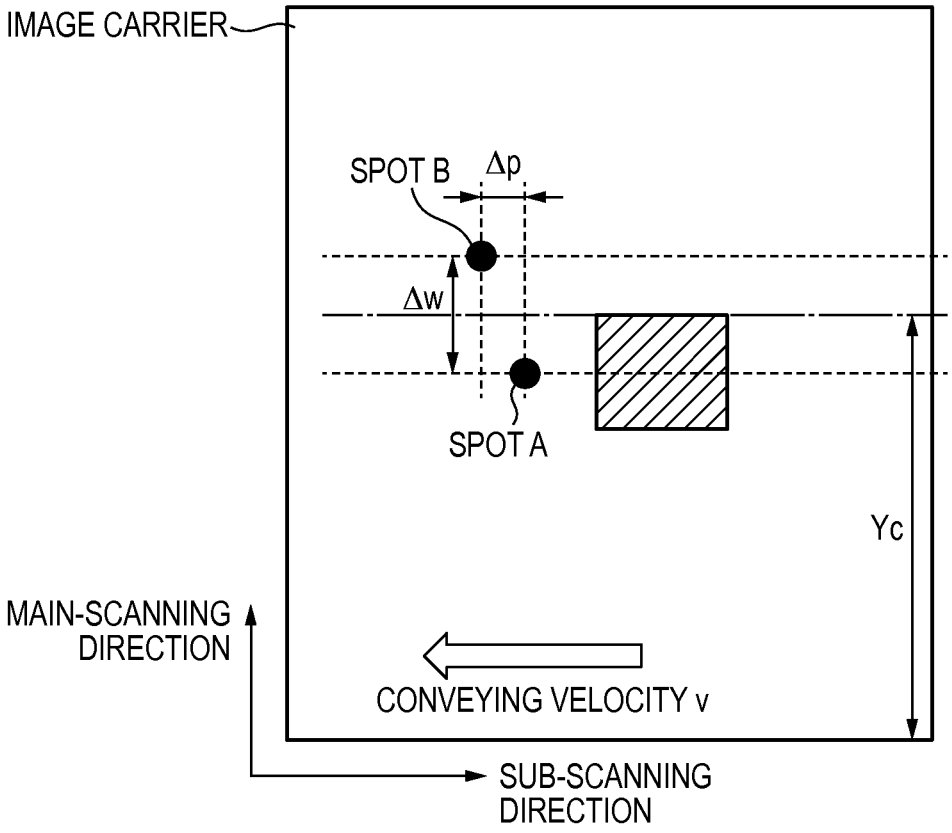
FIG. 18 is a view showing the formation position of a toner patch according to the fifth embodiment.

An exposure laser 102 is controlled to form the toner patch 108 such that an edge of the toner patch 108 is located at the position Yc of the midpoint between light spots A and B detected by the above method. In this manner, as shown in FIG. 18, the toner patch 108 can be formed so as to prevent the toner patch 108 passing through light spot A from passing through light spot B.

However, a method of calculating the position of the midpoint between light spots A and B is not limited to the above method. For example, the positions of light spots A and B in a direction perpendicular to the conveyance direction of a toner image may be calculated first based on $t_1$ and $t_2$, and the average value of the calculated positions may be then calculated. A method of controlling the formation position of the toner patch 108 is not limited to the above method. The shape of the toner patch 108 is not limited to that described above. That is, it is possible to form the toner patch 108 at an arbitrary position decided based on the values $t_1$ and $t_2$ representing the positions of light spots A and B in a direction perpendicular to the conveyance direction of a toner image. For example, the toner patch 108 can be formed such that an edge of the toner patch 108 is located at an arbitrary internally dividing point between light spots A and B.

Figure 19:
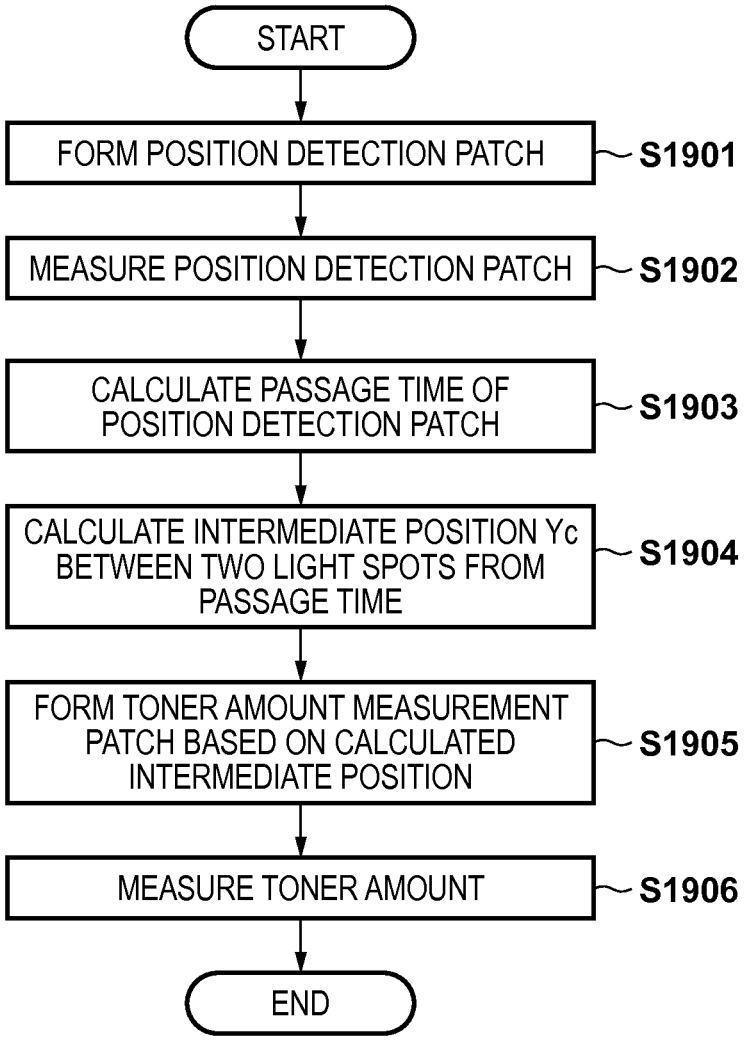
FIG. 19 is a flowchart of processing according to the fifth embodiment.

A method of measuring a toner amount according to this embodiment will be described with reference to the flowchart of FIG. 19. In step S1901, the above position detection patch is formed on the image carrier by an image formation process 201 using the exposure laser 102, a developing device 105, and the like.

In step S1902, the measurement apparatus 107 measures the formed position detection patch. This measurement can be performed according to steps S801 to S805 in FIG. 8. In step S1903, the position determination unit 1601 calculates the times $t_1$ and $t_2$ from the instant the first edge 1701 passes through light spots A and B to the instant the second edge 1702 reaches light spots A and B. In step S1904, using the times $t_1$ and $t_2$, the position determination unit 1601 calculates the coordinate value Yc of the midpoint between two light spots A and B in a direction along the sub-scanning axis 307, as described above.

In step S1905, the toner patch 108 is formed by the image formation process 201 using the exposure laser 102, the developing device 105, and the like such that an edge of the toner patch 108 is located at the position Yc of the midpoint between light spots A and B. Lastly, in step S1906, the measurement apparatus 107 measures the formed toner patch 108. This measurement can be performed according to steps S801 to S808 in FIG. 8.

Sixth Embodiment

In the fifth embodiment, when irradiating the image carrier with two laser light beams, the measurement apparatus 107 measures the position of the light spots. In the sixth embodiment, as in the third embodiment, when irradiating the image carrier with three or more laser light beams, a measurement apparatus 107 measures the positions of the light spots. The following will exemplify a case in which N laser light beams are emitted.

The sixth embodiment also uses a position detection patch like the fifth embodiment. Note however that a position detection patch is configured such that a first edge 1701 and a second edge 1702 of the position detection patch pass through N light spots 1 to N formed by beams 1 to N. In other words, the position detection patch is configured to be larger than the irradiation area of laser light. More specifically, the lengths of the first edge 1701 and the second edge 1702 in a direction along a main-scanning axis 308 are larger than the spreads of light spots 1 to N in a direction along the main-scanning axis 308.

Figure 20:
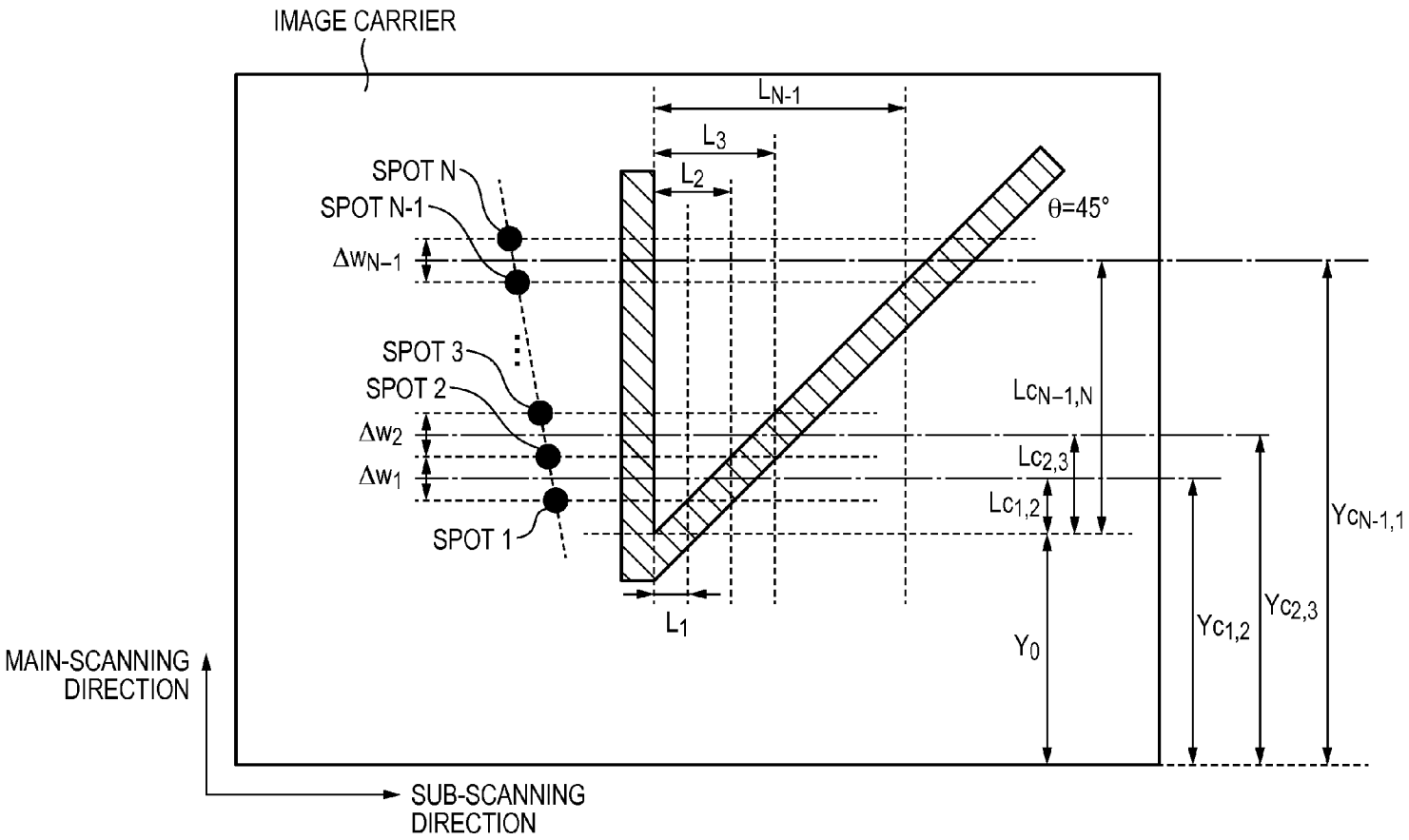
FIG. 20 is a view showing an example of a position detection patch used in the sixth embodiment.

FIG. 20 shows the positions of light spots 1 to N and a position detection patch. In this embodiment, as in the fifth embodiment, the measurement apparatus 107 measures profile data concerning beams 1 to N.

Subsequently, as in the fifth embodiment, a position determination unit 1601 calculates times $t_1$ to $t_N$ from the instant the first edge 1701 passes through light spots 1 to N to the instant the second edge 1702 reaches light spots 1 to N. As in the fifth embodiment, the position determination unit 1601 calculates moving distances $L_1$ to $L_N$ of the position detection patch from the instant the first edge 1701 passes through light spots 1 to N to the instant the second edge 1702 reaches light spots 1 to N.

The position determination unit 1601 calculates the positions of the midpoints between the respective light spots in a direction along the main-scanning axis 308 by using $L_1$ to $L_N$ calculated in this manner. More specifically, as in the fifth embodiment, it is possible to calculate the positions according to the following equations:

$$Lc_{1,2}=(L_1+L_2)/2$$

$$Lc_{2,3}=(L_2+L_3)/2$$

$$\ldots$$

$$Lc_{N-1,N}=(L_{N-1}+L_N)/2$$

$$Yc_{1,2}=Lc_{1,2}+Y_0$$

$$Yc_{2,3}=Lc_{2,3}+Y_0$$

$$\ldots$$

$$Yc_{N-1,N}=Lc_{N-1,N}+Y_0$$

In this case, $Lc_{a,a+1}$ represents the moving distance of the position detection patch from the instant the first edge 1701 passes through the midpoint between light spot a and light spot a+1 to the instant the second edge 1702 reaches this midpoint. In addition, $Yc_{a,a+1}$ represents the location of the midpoint between light spot a and light spot a+1 in a direction along the main-scanning axis 308.

An exposure laser 102 is controlled to form a toner patch 108 such that an edge of the toner patch 108 is located at a position Yc of any of the midpoints between the light spots detected by the above method. For example, the following is a case in which seven laser light beams are emitted, with beams 1 to 3 being used for the measurement of the image carrier and beams 4 to 7 being used for the measurement of the toner patch 108. In this case, the toner patch 108 is formed such that an edge of the rectangular toner patch 108 is located at a position $Yc_{3,4}$ indicating the midpoint between light spots 3 and 4, and the toner patch 108 passes through light spots 4 to 7.

Another example is a case in which beams 1, 2, 5, and 6 are used for the measurement of the image carrier, and beams 3 and 4 are used for the measurement of the toner patch 108. In this case, the rectangular toner patch 108 is formed, which has edges at a position $Yc_{2,3}$ indicating the midpoint between light spots 2 and 3 and a position $Yc_{4,5}$ indicating the midpoint between light spots 4 and 5.

Seventh Embodiment

Figure 21:
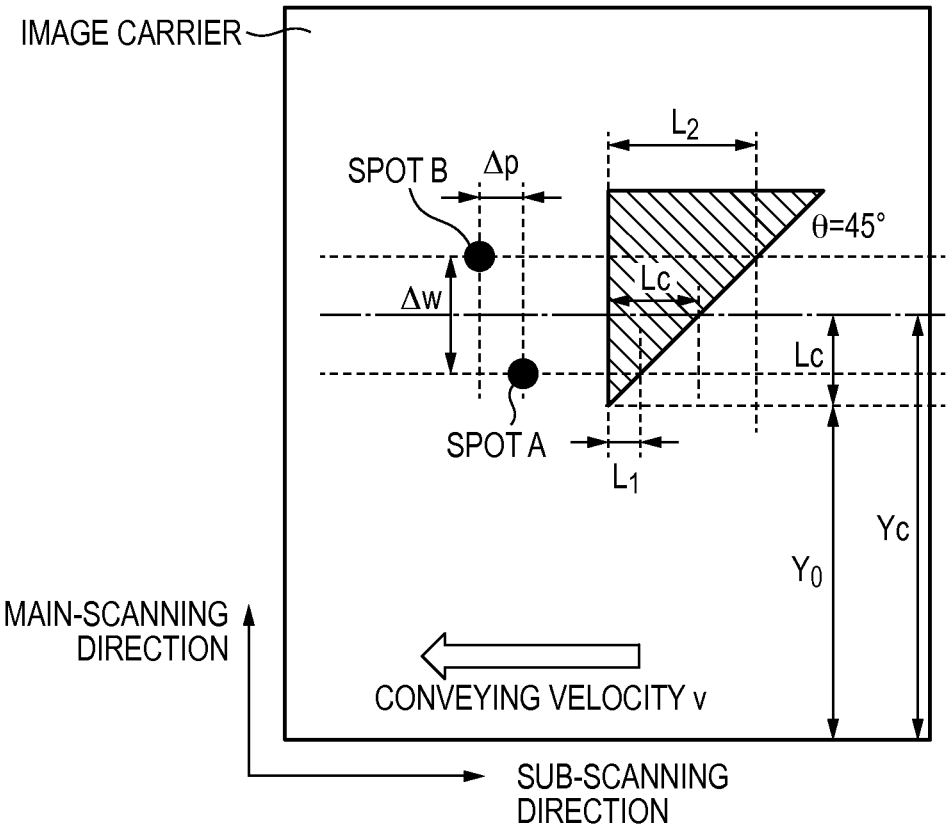
FIG. 21 is a view showing an example of a position detection patch used in the seventh embodiment.

FIG. 21 shows a position detection patch according to the seventh embodiment. The position detection patch shown in FIG. 21 is a triangular patch having a first edge 2101 and a second edge 2102. Since it is also possible to calculate the time from the instant a light spot passes through the first edge 2101 to the instant the light spot reaches the second edge 2102 by using such a position detection patch, it is possible to detect the position of the light spot in the same manner as in the sixth and seventh embodiments. According to this embodiment, since a toner image is formed between the first edge 2101 and the second edge 2102, it is possible to prevent the generation of measurement errors caused by changes in reflection characteristics caused by a deterioration, flows, or the like of the image carrier between the first edge 2101 and the second edge 2102.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-082311, filed Apr. 11, 2014, which is hereby incorporated by reference herein in its entirety.

What is claimed is:

1. An apparatus comprising:

a forming unit configured to form a measurement toner image on an image carrier conveying a toner image, wherein the measurement toner image has different lengths in a conveyance direction for each position in a direction perpendicular to the conveyance direction of the toner image;

a measurement unit configured to emit light to the image carrier conveying the measurement toner image and to measure a length of the measurement toner image passing through an incident position of the emitted light in the conveyance direction of the toner image by observing the emitted light; and a determination unit configured to determine an incident position of the emitted light in the direction perpendicular to the conveyance direction of the toner image in accordance with a measurement result, wherein:

the forming unit is further configured to form the toner image on the image carrier based on a plurality of incident positions of the emitted light determined by the determination unit, wherein the toner image formed on the image carrier passes at least one incident position of the emitted light and does not pass at least one other incident position of the emitted light, the forming unit is further configured to adjust a position of the toner image on the image carrier based on the plurality of incident positions of the emitted light determined by the determination unit, the forming unit is further configured to adjust a position of an edge of the toner image on the image carrier at a midpoint of a first incident position of the emitted light and a second incident position of the emitted light, wherein the toner image on the image carrier passes the first incident position and does not pass the second incident position, and the measurement unit is further configured to emit light to the image carrier conveying the toner image and to measure an incident position of the light in a direction perpendicular to a surface of the image carrier by observing the emitted light, the apparatus further comprising a calculation unit configured to calculate a thickness of the toner image on the image carrier based on an incident position of first light measured by observing the first light entering a surface of the toner image on the image carrier and an incident position of second light measured by observing the second light entering the surface of the image carrier, wherein the first light entering the surface of the toner image on the image carrier and the second light entering the surface of the image carrier are simultaneously observed, wherein the measurement unit comprises an irradiation unit configured to emit the first light and the second light and an observation unit configured to observe the first light and the second light, and the irradiation unit is further configured to emit the first light and the second light at positions separate from each other in a direction perpendicular to a conveyance direction of the toner image on the image carrier, wherein the first light and the second light are irradiated from above the image carrier along the conveyance direction of the toner image on the image carrier.

2. The apparatus according to claim 1, wherein the observation unit comprises an area image sensor configured to capture an image including the emitted first light and the emitted second light.

3. The apparatus according to claim 2, wherein the measurement unit further comprises:

a splitting unit configured to split a captured image obtained by the observation unit into a first region where the first light is reflected and a second region where the second light is reflected, and a detection unit configured to:

detect an incident position of the first light in a direction perpendicular to the surface of the image carrier by detecting a position of the first light in the first region, and detect an incident position of the second light in a direction perpendicular to the surface of the image carrier by detecting a position of the second light in the second region.

4. The apparatus according to claim 1, wherein the measurement unit comprises an irradiation unit configured to emit the first light and the second light and an observation unit configured to observe the first light and the second light, and the observation unit is further configured to detect temporal changes in incident positions of the first light and the second light by continuously performing the observation.

5. The apparatus according to claim 4, wherein the calculation unit is further configured to calculate a thickness of the toner image on the image carrier based on a difference between a first profile representing the temporal change in the incident position of the first light and a second profile representing the temporal change in the incident position of the second light.

6. The apparatus according to claim 1, wherein the second light continues to enter the surface of the image carrier while the first light enters the surface of the toner image on the image carrier.

7. The apparatus according to claim 1, further comprising:

a control unit configured to control the forming unit in accordance with a thickness of the toner image on the image carrier which is obtained by the measurement unit.

8. The apparatus according to claim 7, wherein the measurement unit is further configured to detect the incident position of the emitted light in the direction perpendicular to the conveyance direction of the toner image by measuring the length of the measurement toner image passing through the light in the conveyance direction of the toner image.

9. The apparatus according to claim 8, wherein the measurement toner image includes a first edge perpendicular to the conveyance direction of the toner image on the image carrier and a second edge tilted with respect to the conveyance direction of the toner image on the image carrier and the first edge.

10. The apparatus according to claim 8, wherein the forming unit is further configured to form the toner image on the image carrier at a position decided based on the incident position of the first light and the incident position of the second light which are detected by the measurement unit.

11. A measurement method comprising:

forming a measurement toner image on an image carrier conveying a toner image, wherein the measurement toner image has different lengths in a conveyance direction for each position in a direction perpendicular to the conveyance direction of the toner image;

emitting light to the image carrier conveying the measurement toner image and measuring a length of the measurement toner image passing through an incident position of the emitted light in the conveyance direction of the toner image by observing the emitted light;

determining an incident position of the emitted light in the direction perpendicular to the conveyance direction of the toner image in accordance with a measurement result;

wherein the forming further includes:

forming the toner image on the image carrier based on a plurality of the determined incident positions of the emitted light, wherein the toner image formed on the image carrier passes at least one incident position of the emitted light and does not pass at least one other incident position of the emitted light, adjusting a position of the toner image on the image carrier based on the plurality of determined incident positions of the emitted light, and adjusting a position of an edge of the toner image on the image carrier at a midpoint of a first incident position of the emitted light and a second incident position of the emitted light, wherein the toner image on the image carrier passes the first incident position and does not pass the second incident position, and wherein the emitting further includes emitting first light and second light to the image carrier conveying the toner image, wherein the first light and the second light are emitted to positions separate from each other in a direction perpendicular to a conveyance direction of the toner image, and wherein the first light and the second light are irradiated from above the image carrier along the conveyance direction of the toner image, and the method further comprises:

measuring an incident position of the first light and the second light in a direction perpendicular to a surface of the image carrier through observing the emitted first light and second light; and calculating a thickness of the toner image based on an incident position of the first light measured by observing the first light entering a surface of the toner image and an incident position of second light measured by observing the second light entering the surface of the image carrier, wherein the first light entering the surface of the toner image and the second light entering the surface of the image carrier are simultaneously observed.

12. A measurement method comprising:

forming a measurement toner image on an image carrier conveying a toner image, wherein the measurement toner image has different lengths in a conveyance direction for each position in a direction perpendicular to the conveyance direction of the toner image;

emitting light to the image carrier conveying the toner image;

measuring a length of the measurement toner image passing through an incident position of an emitted light in the conveyance direction of the toner image through observing the emitted light;

determining an incident position of the emitted light in the direction perpendicular to the conveyance direction of the toner image in accordance with a measurement result;

forming a second toner image on the image carrier based on a plurality of incident positions of the emitted light, wherein the second toner image formed on the image carrier passes at least one incident position of the emitted light and does not pass at least one other incident position of the emitted light;

adjusting a position of the second toner image on the image carrier based on the plurality of determined incident positions of the emitted light; and adjusting a position of an edge of the second toner image at a midpoint of a first incident position of the emitted light and a second incident position of the emitted light, wherein the second toner image passes the first incident position and does not pass the second incident position.

13. The apparatus according to claim 1, wherein the irradiation unit is further configured to irradiate the first and the second light obliquely to the image carrier.

14. An apparatus comprising:

a forming unit configured to form a measurement toner image on an image carrier conveying a toner image, wherein the measurement toner image has different lengths in a conveyance direction for each position in a direction perpendicular to the conveyance direction of the toner image;

an irradiation unit configured to emit light to the image carrier conveying the toner image;

a measurement unit configured to measure a length of the measurement toner image passing through an incident position of the emitted light in the conveyance direction of the toner image by observing the emitted light; and a determination unit configured to determine an incident position of the emitted light in the direction perpendicular to the conveyance direction of the toner image in accordance with the measurement result, wherein the forming unit is further configured to form a second toner image on the image carrier based on a plurality of incident positions of the emitted light determined by the determination unit, and wherein the second toner image formed on the image carrier passes at least one incident position of the emitted light and does not pass at least one other incident position of the emitted light, wherein the forming unit is further configured to adjust a position of the second toner image on the image carrier based on the plurality of incident positions of the emitted light determined by the determination unit, and wherein the forming unit is further configured to adjust a position of an edge of the second toner image at a midpoint of a first incident position of the emitted light and a second incident position of the emitted light, wherein the second toner image passes the first incident position and does not pass the second incident position.

15. The apparatus according to claim 14, wherein the irradiation unit is placed upstream from the incident position of the light with respect to the conveyance direction, and the toner image on the image carrier passes below the irradiation unit.

* * * * *